US009765525B2

(12) United States Patent
Harcrow, Jr.

(10) Patent No.: US 9,765,525 B2
(45) Date of Patent: Sep. 19, 2017

(54) MULTIPLE TROUGH GUTTER SYSTEM WITH INTEGRAL DEBRIS BLOCKER

(71) Applicant: Aaron Lavaughn Harcrow, Jr., Smyrna, GA (US)

(72) Inventor: Aaron Lavaughn Harcrow, Jr., Smyrna, GA (US)

( * ) Notice: Subject to any disclaimer, the term of this patent is extended or adjusted under 35 U.S.C. 154(b) by 0 days.

(21) Appl. No.: 15/002,133

(22) Filed: Jan. 20, 2016

(65) Prior Publication Data

US 2017/0204613 A1 Jul. 20, 2017

(51) Int. Cl.
*E04D 13/064* (2006.01)
*E04D 13/04* (2006.01)
*E04D 13/076* (2006.01)

(52) U.S. Cl.
CPC ..... *E04D 13/0767* (2013.01); *E04D 13/064* (2013.01); *E04D 13/04* (2013.01); *E04D 13/0641* (2013.01); *E04D 2013/0413* (2013.01)

(58) Field of Classification Search
CPC ..... E04D 2013/0413; E04D 13/064; E04D 13/0641; E04D 13/04
See application file for complete search history.

(56) References Cited

U.S. PATENT DOCUMENTS 891,405 A * 6/1908 Oassens ..... E04D 13/076 160/44
2,624,299 A * 1/1953 Beegle ..... E04D 13/076 52/16
3,080,682 A * 3/1963 Teutsch ..... E04D 13/076 248/48.2
3,367,070 A * 2/1968 Mitchell ..... E04D 13/0725 210/474
3,388,555 A * 6/1968 Foster ..... E04D 13/076 405/119

(Continued)

FOREIGN PATENT DOCUMENTS

AU WO 9502100 A1 * 1/1995 ..... E04D 13/076
JP 03122355 A * 5/1991
JP 09279781 A * 10/1997 ..... E04D 13/064

OTHER PUBLICATIONS

"Downspouts, Elbows & Outlets Options; www.bbsheetmetal.com", at least as as early as Jul. 1, 2015, 1 page.

(Continued)

*Primary Examiner* — Phi A

(57) ABSTRACT

An interlocking gutter system with perforations in the visor allows for the maximum amount of water drainage while blocking debris from entering the gutter. The gutter trough has an increasing radius as it approaches the downspout, to increase the capacity for carrying water. In the event that debris does enter the gutter, the interlocking mechanism can be disengaged, thereby allowing the gutter trough to drop away from the visor, dumping accumulated debris with minimal effort. The perforations in the visor can be patterned and sized in order to block the most common debris encountered in that installation. The gutter may allow water to enter the trough via a coanda slot in addition to perforations in the visor. The gutter system may have multiple troughs to further assist in draining a maximum amount of water. In the event of a clog, the system is emptied using an endcap.

6 Claims, 23 Drawing Sheets

(56) References Cited

U.S. PATENT DOCUMENTS 3,824,749 A * 7/1974 Scherf ..... E04D 13/152 52/11
4,262,459 A * 4/1981 Hallam ..... E04D 13/064 248/48.2
4,493,588 A 1/1985 Duffy et al.
4,590,716 A * 5/1986 Smith ..... E04D 13/076 52/11
4,631,875 A * 12/1986 Olson ..... E04D 13/064 248/48.2
4,876,827 A * 10/1989 Williams ..... E04D 13/076 210/474
5,154,025 A * 10/1992 Brown ..... E04D 13/0459 52/12
5,406,755 A * 4/1995 Serano ..... E04D 13/076 210/474
5,491,998 A * 2/1996 Hansen ..... E04D 13/076 52/12
5,575,118 A * 11/1996 Vahldieck ..... E04D 13/076 248/48.1
5,588,261 A 12/1996 MacConochie et al.
5,595,027 A * 1/1997 Vail ..... E04D 13/076 52/11
5,791,091 A * 8/1998 Barbera ..... E04D 13/064 52/11
5,852,900 A * 12/1998 Edelman ..... E04D 13/076 52/12
6,016,631 A 1/2000 Lowrie et al.
6,536,165 B2 * 3/2003 Pilcher ..... E04D 13/076 210/474
6,594,956 B1 * 7/2003 Willing ..... E04D 13/076 248/48.2
7,340,863 B1 3/2008 Dressler et al.
7,743,561 B1 * 6/2010 Frederick ..... E04D 13/064 248/48.1
7,752,812 B2 7/2010 Knudson et al.
7,946,081 B1 * 5/2011 Frederick ..... E04D 13/064 248/48.1
8,037,641 B2 10/2011 Gerig et al.
8,800,211 B2 * 8/2014 Sharkey ..... E04D 13/064 52/11
8,997,403 B1 * 4/2015 Steinberg ..... E04D 13/076 52/11
2001/0022052 A1 * 9/2001 Pilcher ..... E04D 13/064 52/14
2006/0021286 A1 * 2/2006 Saville ..... E04D 13/076 52/15
2007/0094940 A1 * 5/2007 Pijanowski ..... E04D 13/064 52/12
2007/0119104 A1 * 5/2007 Pijanowski ..... E04D 13/064 52/11
2007/0220814 A1 * 9/2007 Faulks ..... E04D 13/064 52/12
2009/0320381 A1 12/2009 Gerig et al.
2010/0251626 A1 * 10/2010 Roque Alonso .... E04D 13/0641 52/12
2012/0222366 A1 * 9/2012 Steinberg ..... E04D 13/076 52/12
2013/0097943 A1 * 4/2013 Higginbotham ..... E04D 13/064 52/12
2015/0040489 A1 * 2/2015 Sharkey ..... E04D 13/064 52/12
2016/0273224 A1 * 9/2016 Martin ..... E04D 13/076
2016/0376790 A1 * 12/2016 Yildiz ..... E04D 13/076 52/12

OTHER PUBLICATIONS

"http://www.bbsheetmetal.com/images/products/941/941_1095.pdf", at least as early as Jun. 1, 2015, 3 pages.
"Patent Notes", at least as early as Jul. 2015, 4 pages.

* cited by examiner

MULTIPLE TROUGH GUTTER SYSTEM WITH INTEGRAL DEBRIS BLOCKER

FIELD OF THE INVENTION

The field of the invention relates to gutter systems or the like, and more particularly to debris rejecting and self-cleaning gutter systems.

BACKGROUND

Various means for controlling the dispensation of rain falling on a roof currently exist. When the flow of rain is not properly controlled and directed, erosion of foundation structures may occur, lawn and garden features may be damaged, and rain may run down an exterior wall of the structure, which can damage the structure, perhaps causing leaks into the interior of the structure.

Present systems of gutters are easily clogged by leaves and other debris entering the gutter system, thereby reducing the flow of water, making the gutter less effective. A typical gutter cross-section shape is a rectangular trough design with 90 degree corners, or a designated K-type gutter. Present systems of gutters are difficult to install and are ineffective if they are installed at an incorrect pitch. The pitch of the gutter run is typically less than 1 degree, resulting in the run being nearly level. Over time, debris entering the gutter will collect and buildup in the corners, reducing the capability of the gutter to transport water and may cause the gutter or its supports to fail.

Present systems exist that may be placed over a gutter trough to block debris from entering the gutter system. Systems that block debris from entering the gutter are not very effective, still allowing some debris to enter the gutter, and still have to be cleaned from time to time. Cleaning them is a difficult, time-consuming process that can be dangerous. Cleaning such a debris blocking system requires spending long periods of time perched precariously on a roof or on top of a tall ladder or scaffold while exerting great muscular effort in an awkward position. In some cases, the entire gutter must be disassembled to be cleaned.

Some existing systems have a gap between the gutter and the debris blocking system to allow water to enter the gutter. These systems may only be effective when the momentum energy of the debris is sufficiently high for the trajectory of the debris to go over the gap between the gutter and the gutter-covering device. When the rainfall intensity, or mass flow, is not adequate to convey the debris with enough momentum, then the debris will fall into the gap, entering the gutter. When the rainfall intensity, or mass flow, is too high, the rain has sufficient momentum to continue its trajectory and to overcome the surface tension forces that would keep it flowing along the surface of the gutter-covering device. Thus, instead of entering the gutter, the rain falls beyond the gutter and may cause the same undesirable results as if there was no gutter. Other gutter covers merely trap the unwanted debris when the momentum energy of the debris is not sufficient to wash the debris over the edge, leading to the debris blocking system becoming clogged, impeding the flow of water.

It is desirable in some instances to have an easy to install gutter system that effectively blocks debris from entering the system, but is easy and efficient to clean if the gutter system becomes clogged. It is also desirable in some instances for a gutter system to have an increased accommodation for water flow, so that the gutter system will not overflow and cause water to run back up onto the roof or behind the gutter.

It is desirable to have a gutter system be effective over a broad range of rainfall mass flow rates. It is desirable to have a gutter system that is self-cleaning. Such a gutter system would have improved durability and reliability over existing systems.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

One non-limiting embodiment of the present invention is an improved rain gutter system suitable for receiving a great amount of rain flowing from a roof of a structure and directing the rain to a desired effluence location. The system is designed to receive the rain, to prevent the admittance of debris, and to convey the rain to a collection point, such as a downspout. The gutter system can be adapted to any length of roof. The gutter system is easy to attach to a building or other structure. The gutter system has components to operate in interior and exterior roof corners and the components can be connected to adjacent gutter run components. Some embodiments of the gutter system have structural stiffeners built in. The gutter system is easy to clean in the event that debris or other material does accumulate in the gutter. Some embodiments of the gutter system also provide an auxiliary means of dispensing large amounts of rain.

DETAILED DESCRIPTION

Figure 1A:
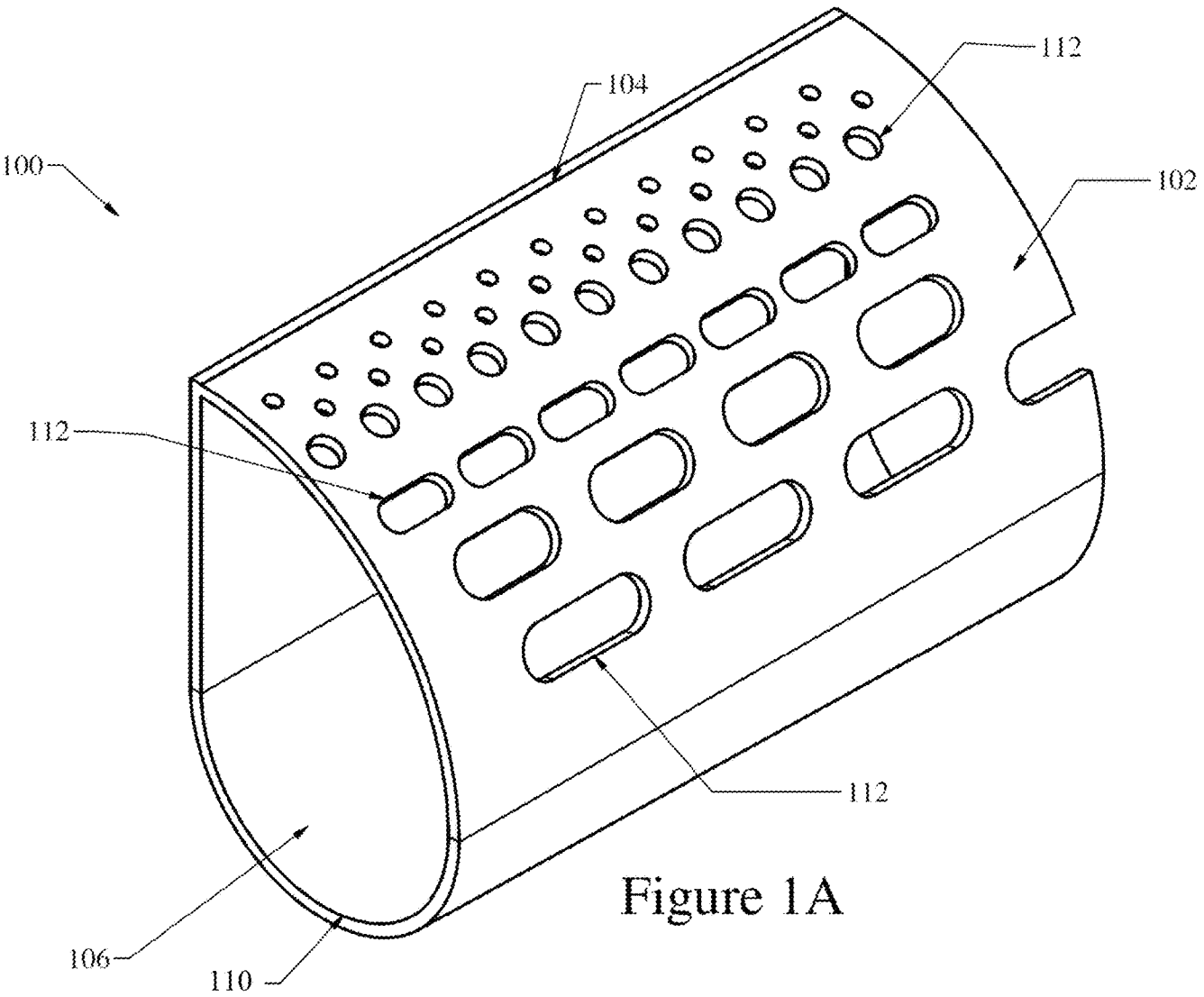
FIGS. 1A through 1D illustrate a first embodiment of a gutter system.
Figure 1B:
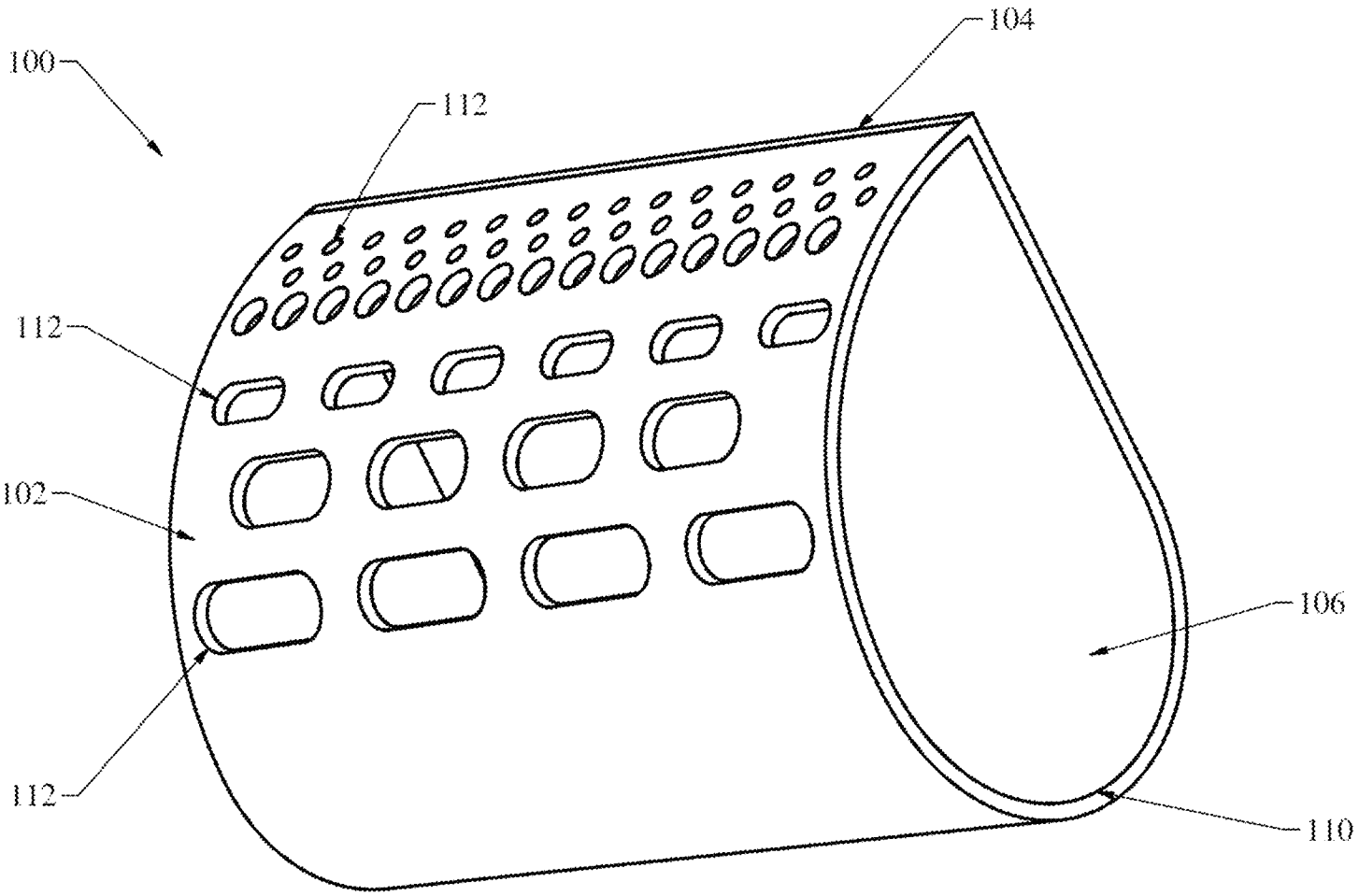

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The described embodiments of the invention provide for a self-cleaning gutter system with integrated debris blockers. While the gutter systems are discussed for use with residential homes, they are by no means so limited. Rather, embodiments of the gutter system may be used in any structure that requires capture and drainage of rainwater.

The following is a description of devices, such as roof gutters, that are able to drain water flowing off of a structure, such as a building. The gutter systems described below feature improved performance in preventing debris from entering and potentially clogging the gutter. In some instances, the device is able to be opened and closed in the event that debris does accumulate inside the device. In some instances, the device is also self-cleaning, by way of a smooth, concave, curved profile on the inside of the gutter run that directs and concentrates water and debris to the lowest point in the gutter profile, thereby allowing the water and debris to flow freely. In some embodiments, the device incorporates a coanda slot along the front of the device, such that water enters the device because of surface tension, and debris falls over the edge of the device onto the ground or a similar surface. The visor, or upper surface, of the gutter might have holes of varying size and shape that allow water to flow into the gutter trough, while preventing debris from entering the gutter trough.

The device may be fabricated from various materials, such as, but not limited to, aluminum, steel, copper, brass, bronze, lead, or another sheet metal; sheet plastic; extruded metal; extruded plastic; a laminated fiber reinforced plastic, such as fiberglass reinforced epoxy, graphite epoxy (Gr/Ep), fiberglass (Fg) Polyester, or any other such material that allows for an appropriate amount of flexibility while having the appropriate structural integrity. The device may be fabricated using various manufacturing processes, including, but not limited to roll forming or progressive roll forming; bending and forming using forms, mandrels, press and other brakes, punches, or dies; compound extrusion of plastics; injection molding using various types of molding; or lamination of fiber reinforced plastic and associated processes and materials, including pre-preg, wet layup, molded layup, vacuum bagging, post-curing, autoclave curing, and other types of manufacturing that may be envisioned.

The device may be attached to a structure in various ways. In one embodiment, perforations in the gutter may be made to allow insertion of a mechanical fastener, such as a screw, nail, staple, or other suitable fastener. A tool appropriate for addressing the mechanical fastener is used such that the mechanical fastener will be secured through the gutter and into the fascia to hold the gutter in the desired position. Each mechanical fastener may be vertically adjustable within the perforations, such that a user may easily adjust the pitch of the gutter run to ensure that water flows in the proper direction towards the downspout. In another embodiment, an external hanger device may be attached to the fascia of the structure to support the gutter.

In a preferred embodiment, a section of gutter run is formed using a single piece of sheet material. The section of gutter run can be any length, up to and including the length of the structure. An upper portion of the material after forming is known as a visor. This portion may also be called a screen, grate, or strainer. A lower portion of the material after forming is known as a trough. The visor and the trough are connected by a straight portion, whereby the gutter is connected to the structure. The visor may have a plurality of holes, or perforations, through it. The holes are of a size, shape, orientation, pattern, gradation, ordering, and spacing that allows rain to pass through the visor while preventing debris from entering the gutter and thereby clogging the trough. Various patterns and combinations of holes may be envisioned. One reason to vary the patterns and combinations of holes may be because a particular type of debris is present on the property, such as oak, pine, tulip, or Bradford pear trees. Other reasons to vary the patterns and combinations of holes can be envisioned. The trough concentrates the flow of rain to the lowest point in the gutter (which may be facilitated, for example, by the smooth, concave shape of the trough) so that any debris that does enter the trough through the holes does not accumulate, but is instead efficiently swept along the run of the gutter to the downspout.

Figure 8A:
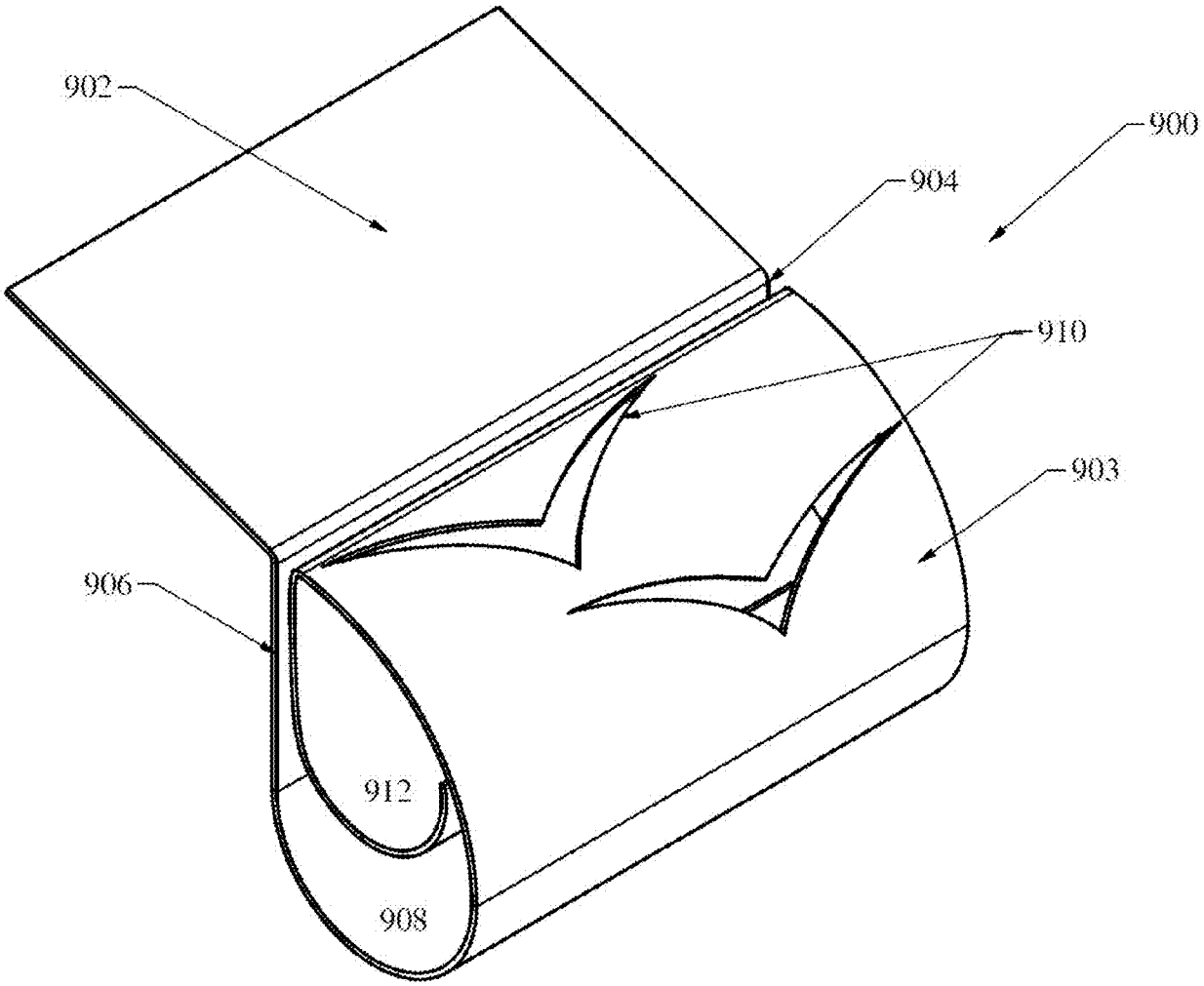
FIGS. 8A through 8C illustrate another embodiment of a gutter system including chevron shaped holes in a visor and a flange under shingles feature.
Figure 8B:
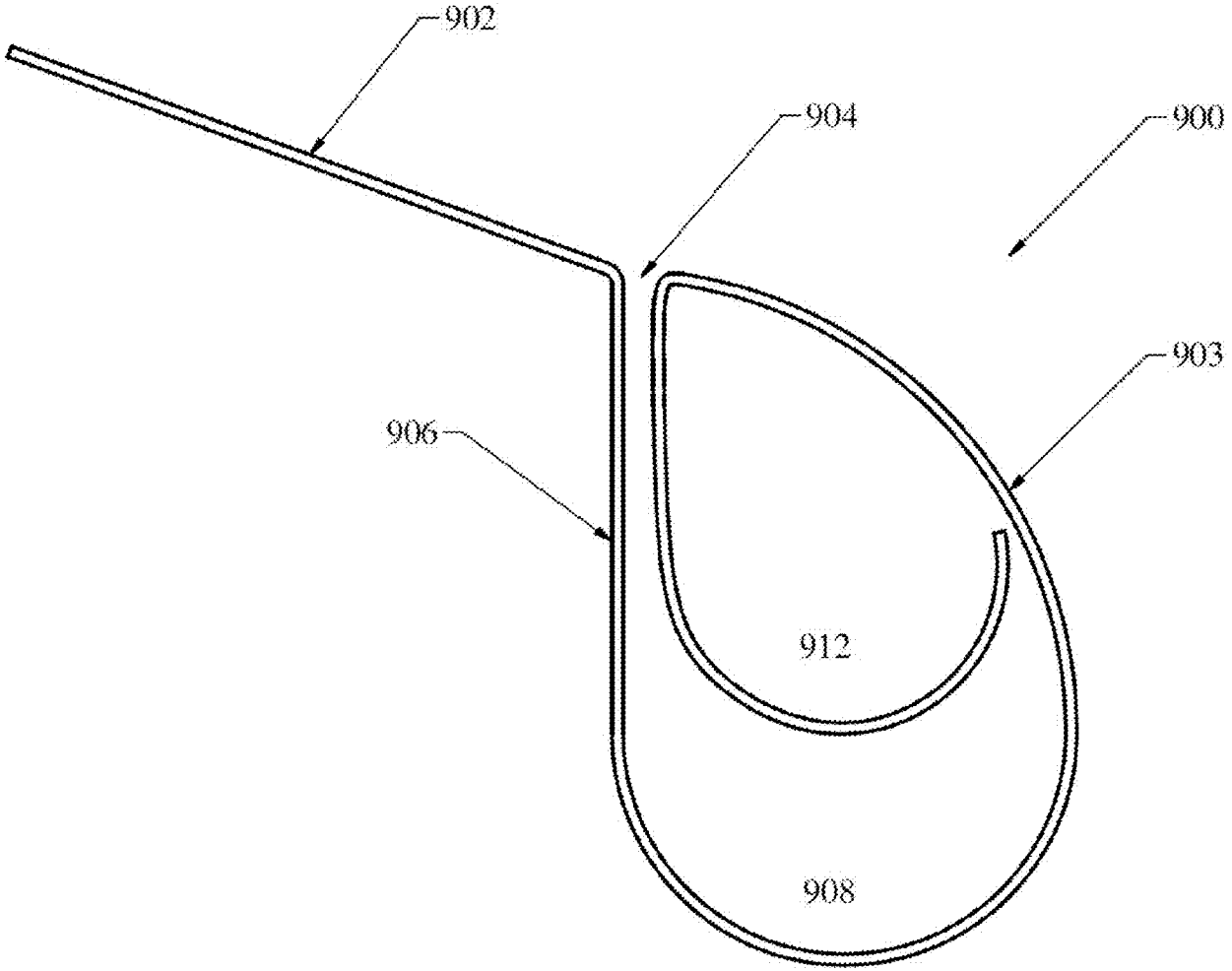
Figure 8C:
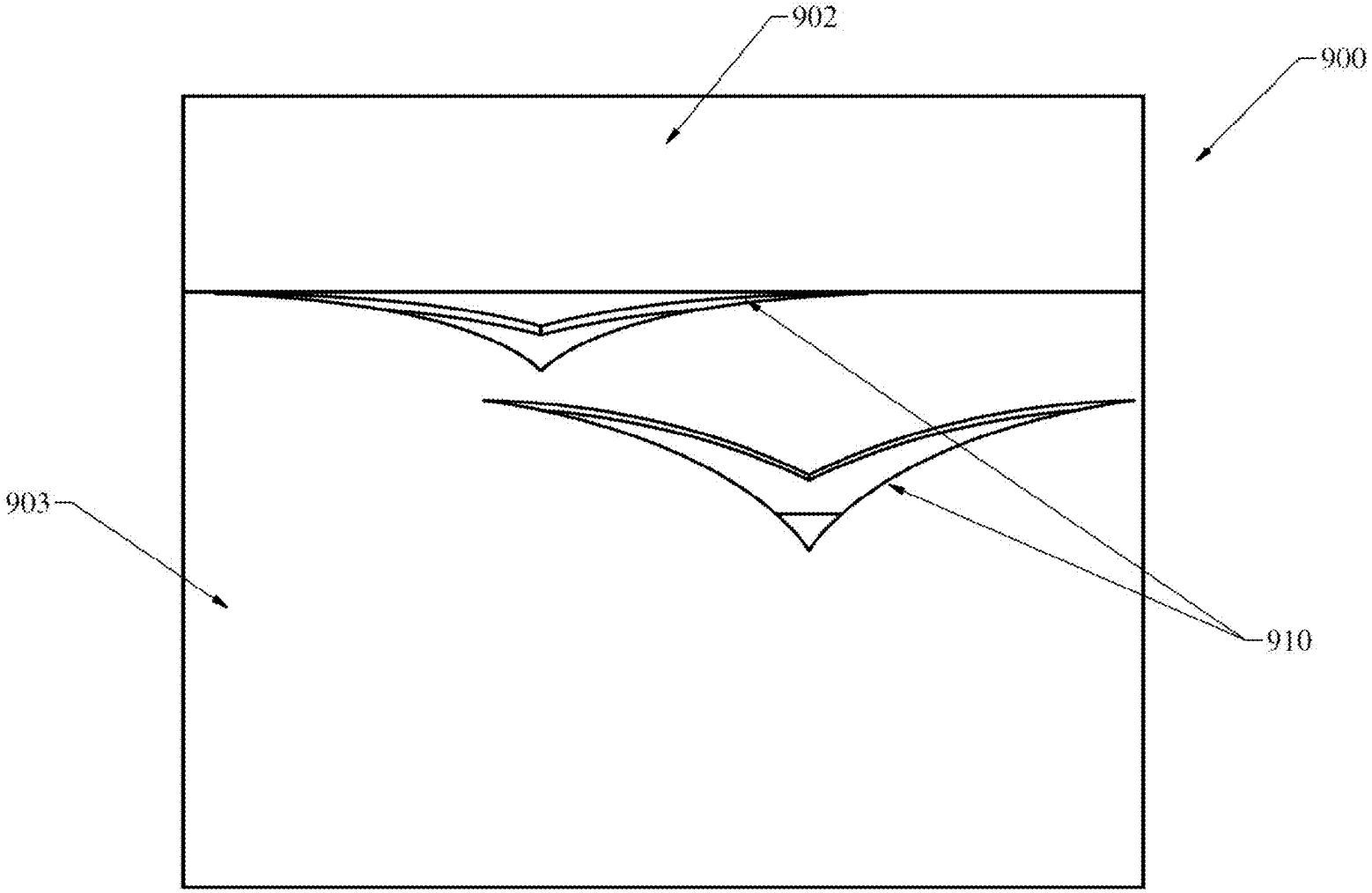

FIGS. 1A-1D show one example of an interlocking roof gutter 100. The gutter 100 includes a visor 102 with a plurality of holes 112 to capture water that is flowing down the visor 102. In this particular example, the height of the visor 102 is constant along the gutter run. Other embodiments may include visors where the height of the visor is not constant. In one embodiment, the gutter 100 may be installed such that the top edge 104 of the visor 102 is a constant distance from the roof to prevent the backflow of water between the visor 102 and the structure. In another embodiment, the gutter 100 might incorporate a flange under shingles feature to prevent water from flowing behind the gutter 100, such as shown in FIGS. 8A-C.

Figure 1C:
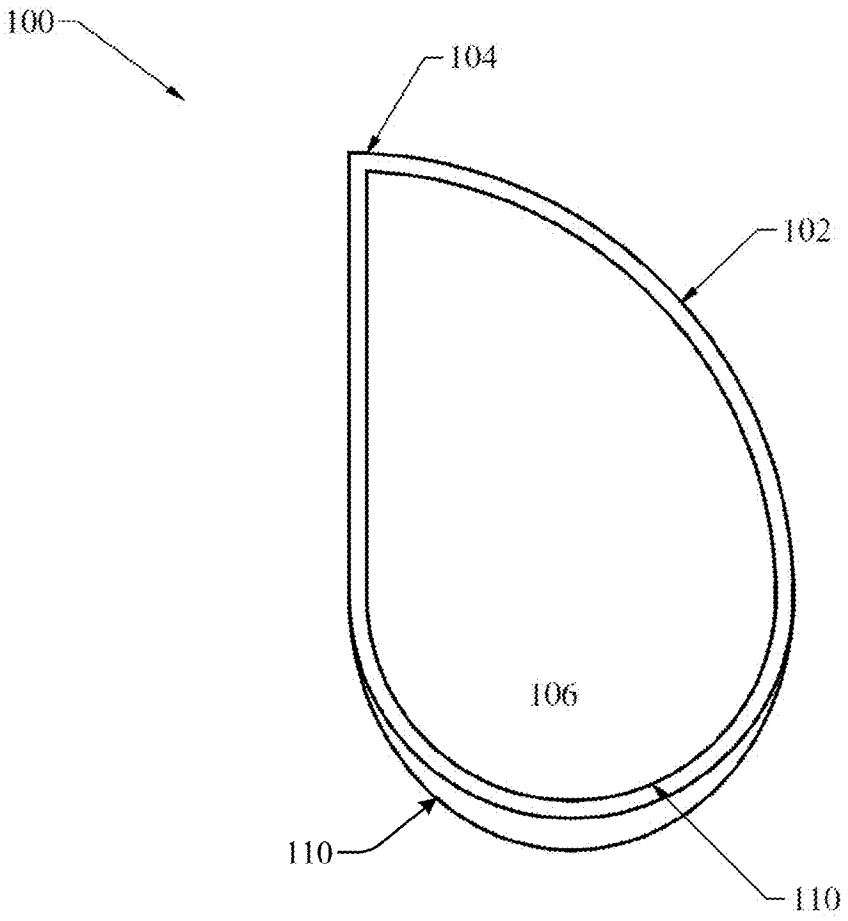
Figure 1D:
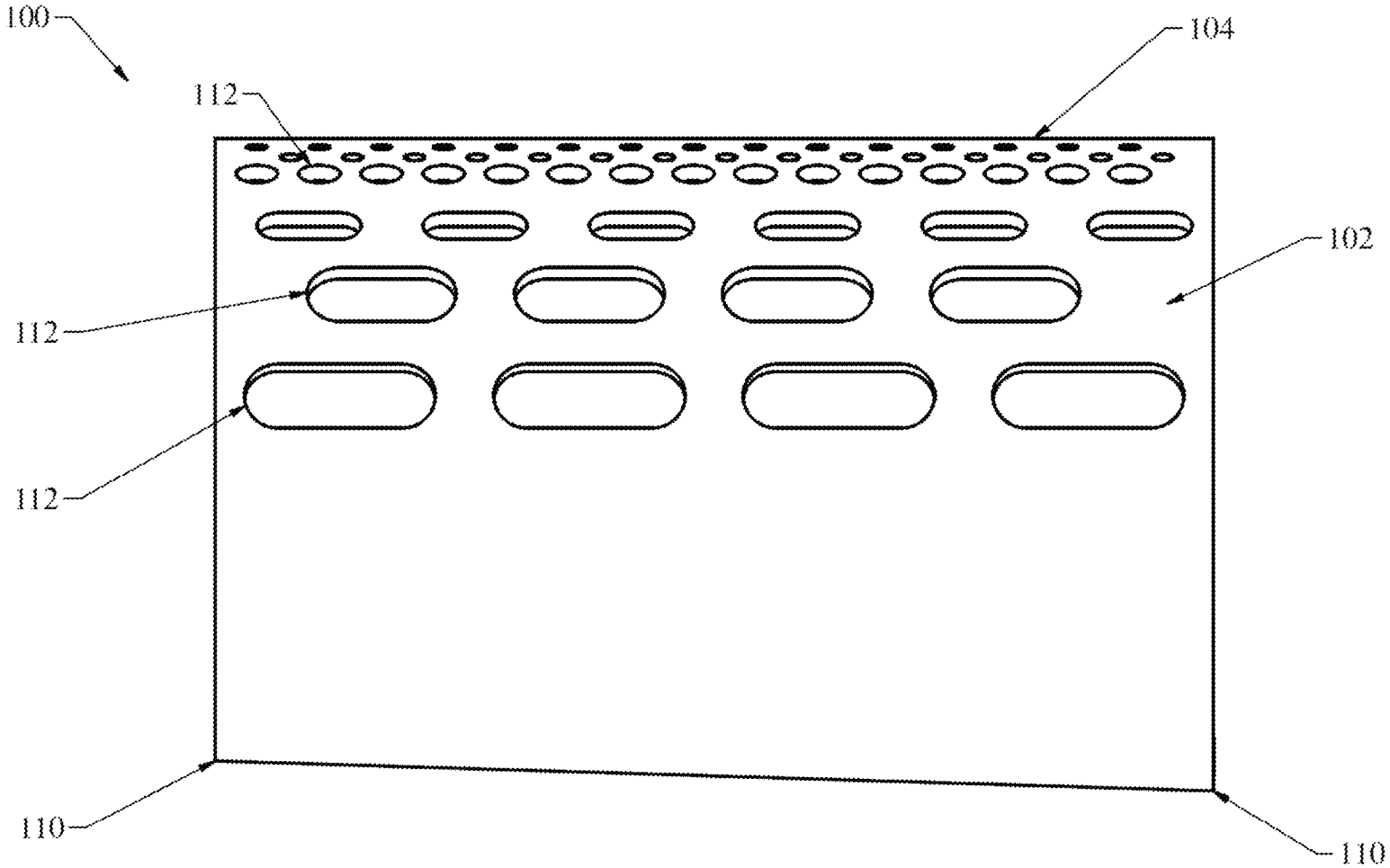

The gutter system 100 of FIGS. 1A-1D includes a trough 106. The pitch of the bottom of the trough 106 may slope downward along the length of the gutter 100 as the gutter 100 approaches the downspout in order to encourage the flow of water to the downspout. In this embodiment, the depth of the trough 106 increases along the length of the gutter 100. In this way, the volume capacity of the interior of the trough 106 increases as it approaches the downspout, so that the trough 106 is able to carry increasing amounts of water along its length. As illustrated in FIG. 1D, the increasing depth of the trough 106 causes the bottom edge 110 of the interlocking roof gutter 100 to be farther from the top edge 104 of the visor 102 at the end of the gutter 100 nearer the downspout than it is at the end of the gutter 100 farther from the downspout. Other embodiments may have a trough 106 with a constant cross section as it approaches the downspout. Some embodiments, such as, for example, those described below, may also feature one or more troughs with a slope or taper to increase water capacity as the water moves through the gutter and towards a downspout.

As shown in FIGS. 1C and 1D, the visor 102 falls away from the top edge 104 of the gutter 100 in a constant radius. As the visor 102 falls away from the top edge 104 with a gradually increasing slope, the holes 112, which may take on any shape as desired or required for aesthetic purposes or to facilitate better water entrapment and exclusion of debris, may become progressively larger. In other embodiments, the visor 102 does not need to fall away from the roof in a constant radius and may fall away from the roof in a changing radius or other manner. Having the visor 102 fall away from the roof with a gradually increasing slope, such as shown in FIG. 1C, or in other embodiments with constant or non-constant radii, will cause the water to fall along the visor 102 with minimal splashing back up onto the roof. Because the visor 102 has a gradually increasing slope, gravity will accelerate the water as it flows down the visor 102. The increasing rate of water flow and the gradually increasing slope both operate to accelerate the debris, increasing its momentum as it moves along the visor 102. The increase of momentum in the debris allows for the holes 112 to gradually increase in size because the accelerated debris will pass over the holes 112 and fall away from the structure. However, the larger holes 112 may still capture the water as it accelerates down the slope of the visor 102. Conversely, near the top of the visor 102 where the water and debris have less momentum, the holes 112 are smaller to prevent debris from entering the gutter 100, yet still entrain water.

Figure 2A:
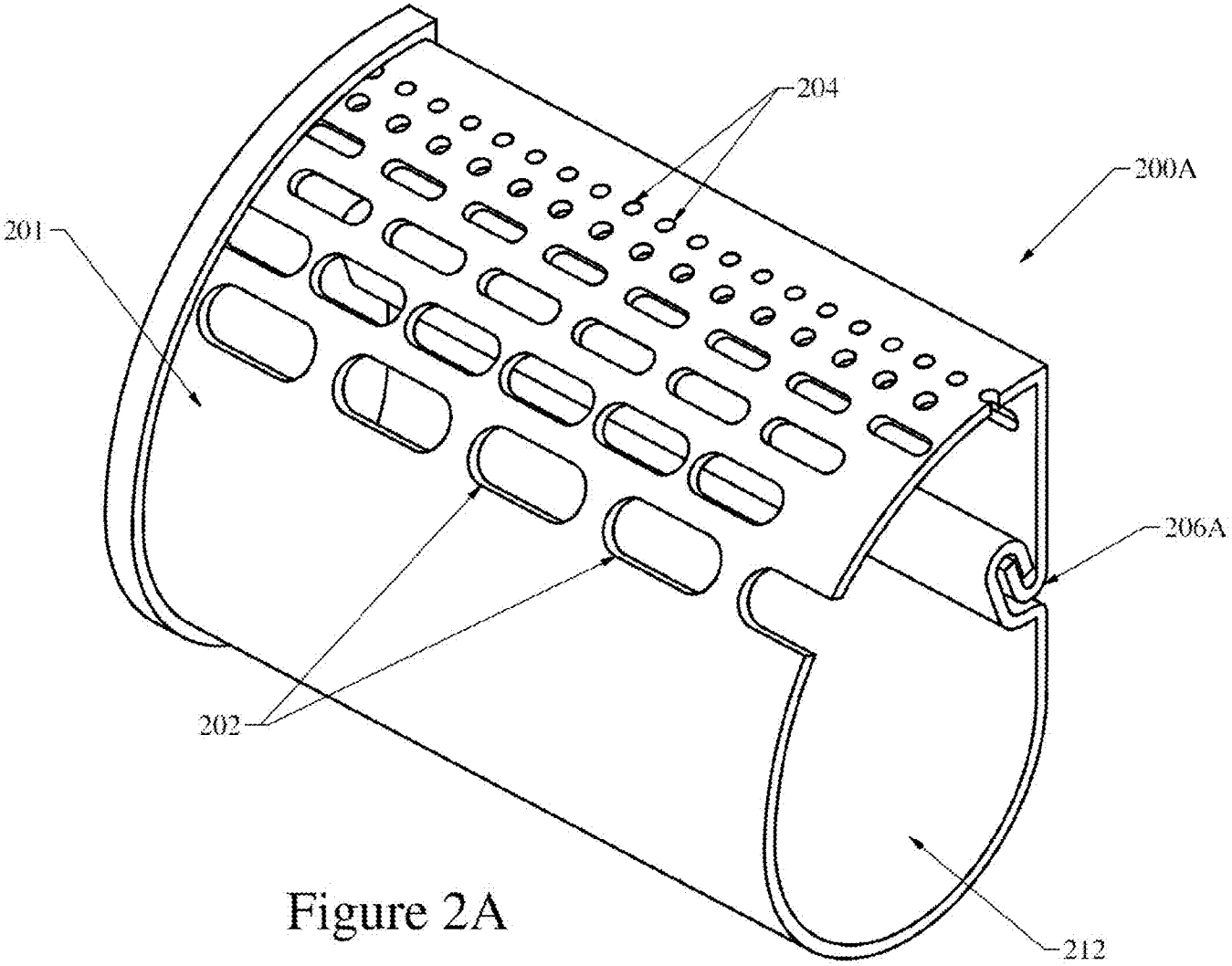
FIG. 2A illustrates an embodiment of a gutter system including an interlocking mechanism on the rear of the gutter.

FIG. 2A illustrates another example of a gutter 200A that includes holes 202, 204 in the visor 201 and an interlocking mechanism 206A located on the rear of the device. In this embodiment, the holes 202 closer to the ground are of a larger size than the holes 204 closer to the roof. This serves to allow water to flow freely into the trough 212 due to surface tension, while filtering out the most debris. Holes of a single size and shape are less desirable because they would not be suited for all possible conditions of rainfall intensity, leaf size and shape, the size and shape of other possible debris, wind velocity, and other factors affecting the fall of debris. The holes 202, 204 may be punched, dimpled, or indented in a manner that promotes the use of the coanda effect to draw water into the holes 202, 204 and through the visor 201, falling into the trough 212. The interaction of the surface tension of the water and the momentum of the rain and debris causes holes 202, 204 of varying sizes to be desirable. It is possible to envision a different distribution of holes 202, 204 in the visor 201. The holes 202, 204 should be of a size, shape, orientation, pattern, gradation, ordering, and spacing that allows rain to enter the trough 212 while preventing most debris from entering the trough 212.

The interlocking mechanism 206A is located on the rear of the gutter 200A in this embodiment, with the rear being the section that is mounted to the structure. The interlocking mechanism 206A can be folded flange edges, although other types of interlocking mechanisms can be envisioned. The interlocking mechanism 206A may also be a closing seam or latching seam with a hem at both seams. Appropriate types of seams for latching or interlocking the gutter 200A include a grooved seam joint, a cap strip seam, a drive slip joint, and a flat lock seam. In the event that the gutter system 200A becomes clogged, the user would simply push up on the trough 212 and squeeze the rear of the trough 212 forward to unlatch the interlocking mechanism 206A. Then the trough 212 may be lowered to empty the debris. One way of lowering the trough 212 is for gravity to act upon the debris in the gutter 200A, such that the curvature of the front of the gutter 200A may act as a living hinge and allow it to open and dump its contents. To reclose the gutter 200A, the user would simply push the trough 212 up while squeezing the rear forward again to engage the interlocking mechanism 200A. It is possible to envision a gutter 200A that would have a different type of locking mechanism 206A, and/or a hinge, for example, if the gutter 200A is made of a non-flexible material.

Figure 2B:
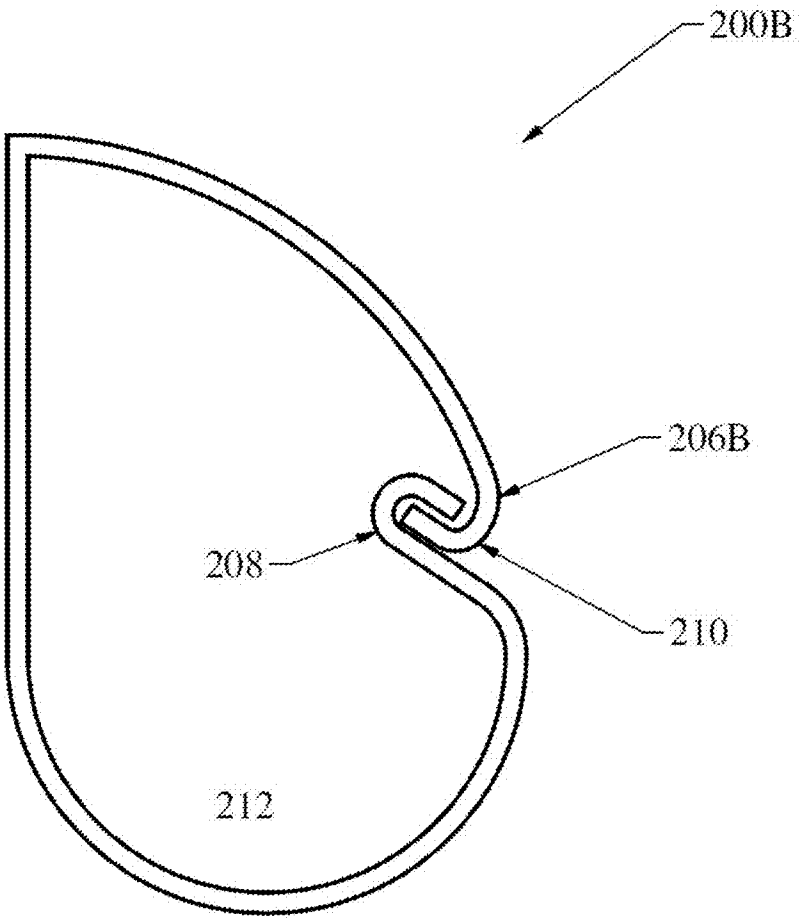
FIG. 2B illustrates an embodiment of a gutter system including an interlocking mechanism on the front of the gutter.

FIG. 2B illustrates an embodiment of a gutter 200B where the interlocking mechanism 206B is located on the front of the gutter 200B. In this embodiment, to unlatch the locking mechanism 206B, the user squeezes the trough 212 such that the front of the trough 212 moves toward the structure, and slightly lifts the front of the trough 212. This causes internal latching mechanism 208 to separate from external mechanism 210. When the user lets go, gravity operating on the debris in the trough 212 may cause the curvature of the gutter trough 212 to straighten, allowing the debris to be dumped. Afterwards, the same squeezing and lifting motion may be used to re-engage locking mechanisms 208 and 210. The mechanisms 206A and 206B shown in FIGS. 2A and 2B respectively are only one example of mechanisms that may be used to close and secure the gutter 200A, 200B. For example, in some embodiments, other mechanical fasteners, such as screws, folding tabs, or twist tabs may be used instead of the specific mechanisms shown in FIGS. 2A and B.

Figure 3:
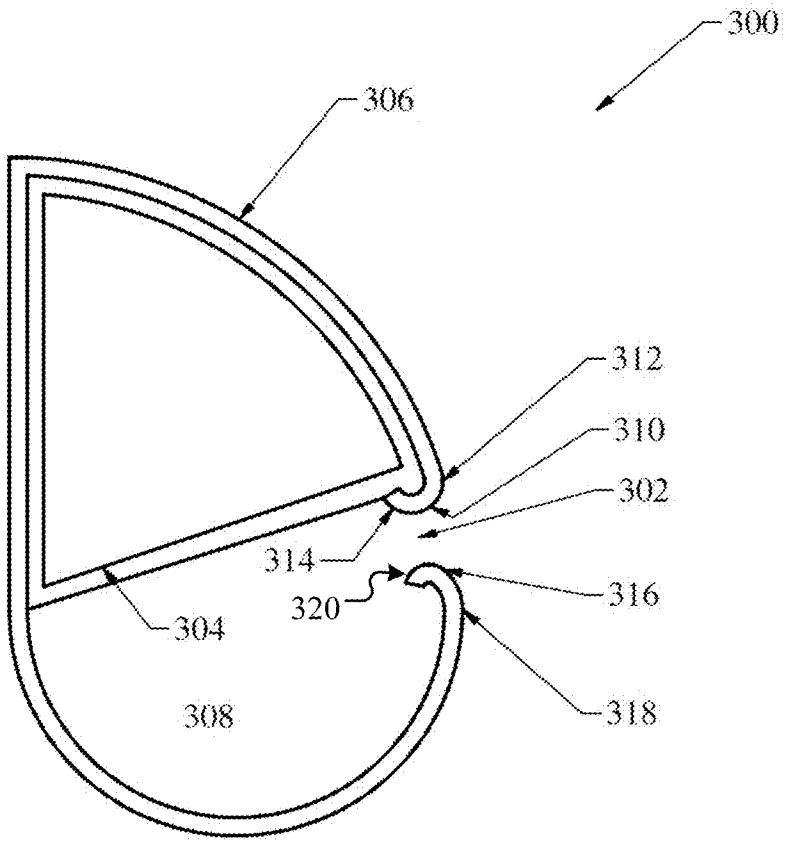
FIG. 3 illustrates another embodiment of a gutter system including a coanda slot that allows water to enter through it.

FIG. 3 illustrates an embodiment of a gutter 300, which may also include holes in the visor 306, that allows water to enter through a coanda slot 302. The visor 306 still has the plurality of holes discussed above. A frame 304 supports the visor 306 of the gutter 300 and provides structural integrity. In times of increased rain flow, water flowing down over the visor 306 of the gutter 300 may not enter the holes, thereby adhering to the visor 306 and entering the gutter trough 308 through the coanda slot 302. Debris falling onto the gutter 300 will have a momentum that is too high for it to adhere to the visor 306 or will be too large to pass through the coanda slot 302 and will fall away from the building. In the event that debris does enter the gutter trough 308, the gutter 300 may still be easily opened for cleaning.

Still referring to FIG. 3, the coanda slot 302 may utilize the coanda effect to help entrain water into the trough 308. However, the geometry and relative positioning of the coanda slot 302 may also help to entrain water while rejecting debris. In certain embodiments, the coanda slot 302 may comprise an upper curve 310 with an outer slope 312 and an inner slope 314. The coanda slot 302 may also comprise a lower curve 316 which also has an outer slope 318 and an inner slope 320. The lower curve 316 may be positioned outward or inward relative to the upper curve 310. This positioning may influence the fall path of water and/or debris as it moves down the visor 306 and towards the coanda slot 302. As the water and/or debris move towards the coanda slot, the contour of the upper curve 310, including the relative slopes of the outer portion 312 and inner portion 314, will determine the fall path of water and debris as it leaves the surface of the visor 306. Water, due to the coanda effect, surface tension, or other factors, will tend to adhere more closely to the upper curve 310 and fall closer to the trough 308. By contrast, debris will not follow the curvature of the upper curve 310, and may have a fall path that is relatively further from the trough 308. The lower curve 316 may then be positioned relative to the upper curve 310 such that the fall path of water leads it to contact the inner portion 320 and be directed into the trough 308. Debris, with a fall path relatively further from the trough 308, may contact the outer portion 318 of the lower curve 316 and be directed away from the trough 308. In some embodiments, the upper curve 310 and/or lower curve 316 may be replaced by angles, corners, or creases.

Figure 4A:
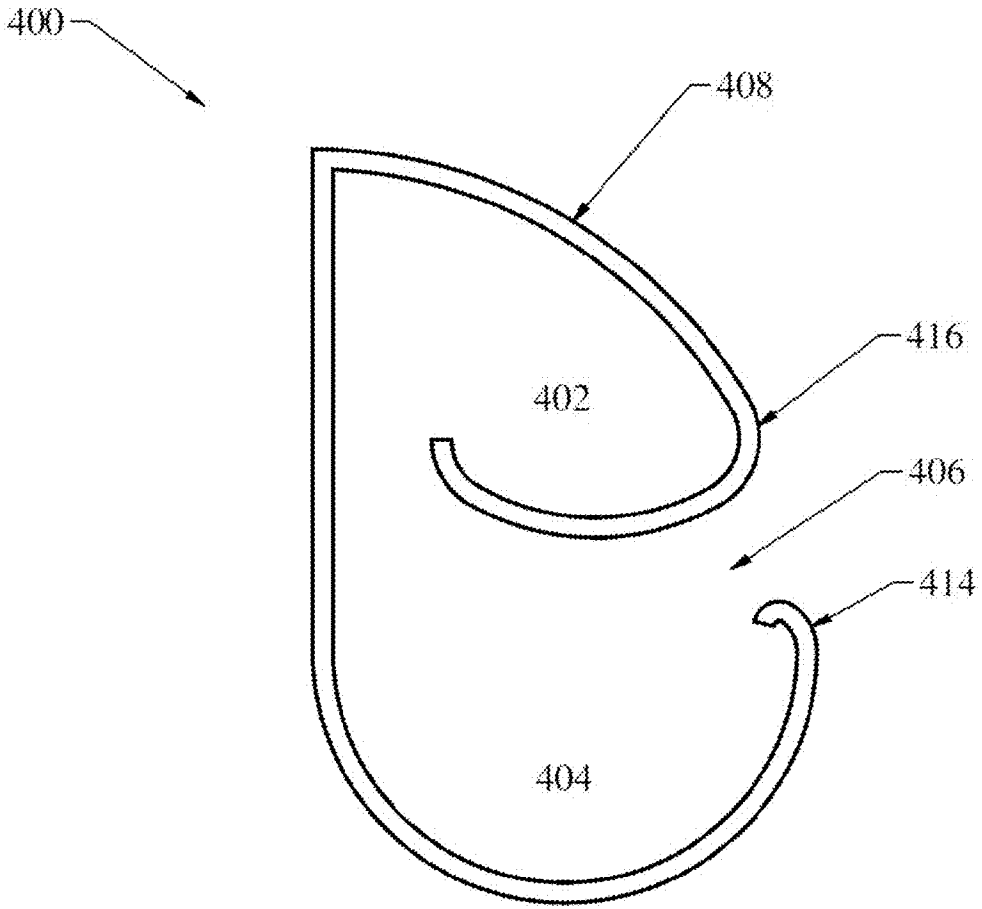
FIGS. 4A and 4B illustrate another embodiment of a gutter system having a coanda slot, an upper trough, and a lower trough.
Figure 4B:
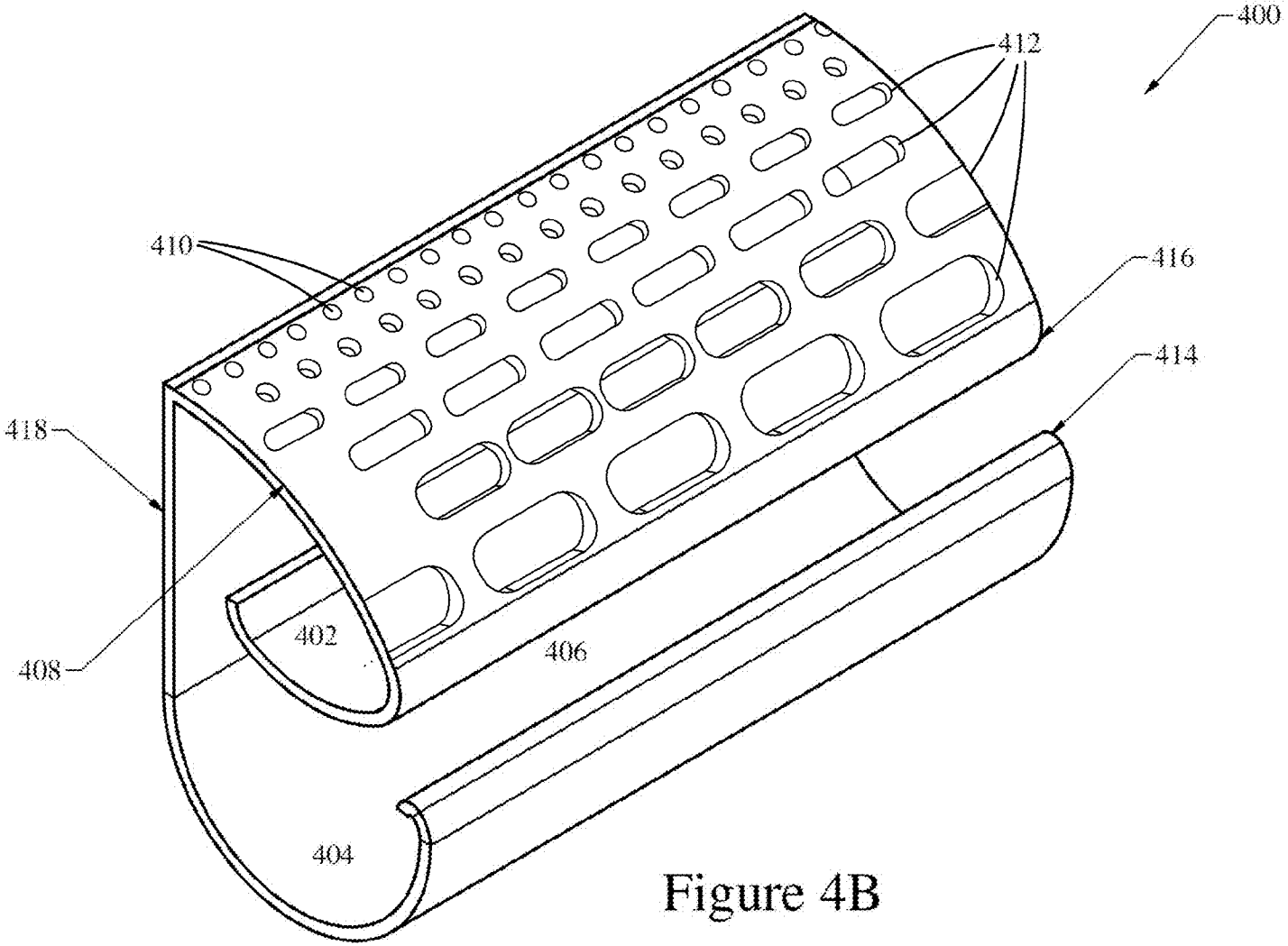

FIGS. 4A and 4B illustrate a cross section of another embodiment of a gutter system 400. The gutter 400 has an upper trough 402 and a lower trough 404. The upper trough 402 is an extension of the visor 408. The cross-section profile of the lower trough 404 of the gutter 400 inversely tapers from smaller to larger size along the run of the gutter 400 to the downspout, thereby causing the lower trough 404 basin to become farther from the roof as it approaches the downspout. This inverse taper profile to the gutter 400 increases the water capacity as it collects more water and moves it towards the downspout. The gutter 400 takes advantage of the coanda effect by utilizing the smoothly curved lower edge 416 of the visor 408 as a coanda surface and locates a coanda slot 406 between the coanda surface and the lower trough 404. This arrangement provides several effects that promote the flow of water into the gutter 400 while excluding undesirable debris. Water falling onto the visor 408 from the shingles will have a certain velocity caused by the rate of rainfall and the size of the roof Because of viscosity, the water imparts momentum to any debris that may be entrained in the water flow. Initially, water will enter the upper trough 402 via the plurality of smaller holes 410, but the debris will be predominantly excluded. Gravity will accelerate both the water and the debris. As the water and debris flow along the visor 408, the slope of the visor 408 becomes more vertical and the velocity of the water and debris increases. Due to the coanda effect, water will enter the upper trough 402 via the perforations 412, but the debris will have sufficient momentum to continue to fall and will not enter the perforations 412 in the visor 408 or the coanda slot 406. Instead, the debris will fall off the edge of the gutter 400 away from the structure. The coanda effect is further enhanced by the plurality of perforations 412 having an indented or dimpled shape which provides additional coanda surface to draw water into the upper 402 and lower 404 troughs. The upper edge 414 of the lower trough 404 adjacent to the coanda slot 406 also curves inward and is offset slightly away from the lower edge 416 of the coanda surface. This helps to draw water flowing past the visor 408 into the lower trough 404 because it will fall onto a smooth surface below, guiding the water into the lower trough 404 by the coanda effect. This offset also helps to exclude debris from entering the lower trough 404.

During low to moderate intensity of rainfall, most water will pass through the plurality of holes 410, 412 in the visor 408 and collect in the upper trough 402 to flow to the downspout. During high intensity of rainfall, there may be too much water to flow through the plurality of holes 410, 412 in the visor 408. In that situation, excess water will enter the lower trough 404 by way of the coanda slot 406 and flow to the downspout. If the intensity of rainfall also causes the upper trough 402 to fill with water passing through the plurality of holes 410, 412, the overflowing water will cascade from the upper trough 402 to the lower trough 404, through the gap between the upper trough 402 and the rear wall of the gutter 418. In this way, the water will still flow to the downspout.

Figure 5:
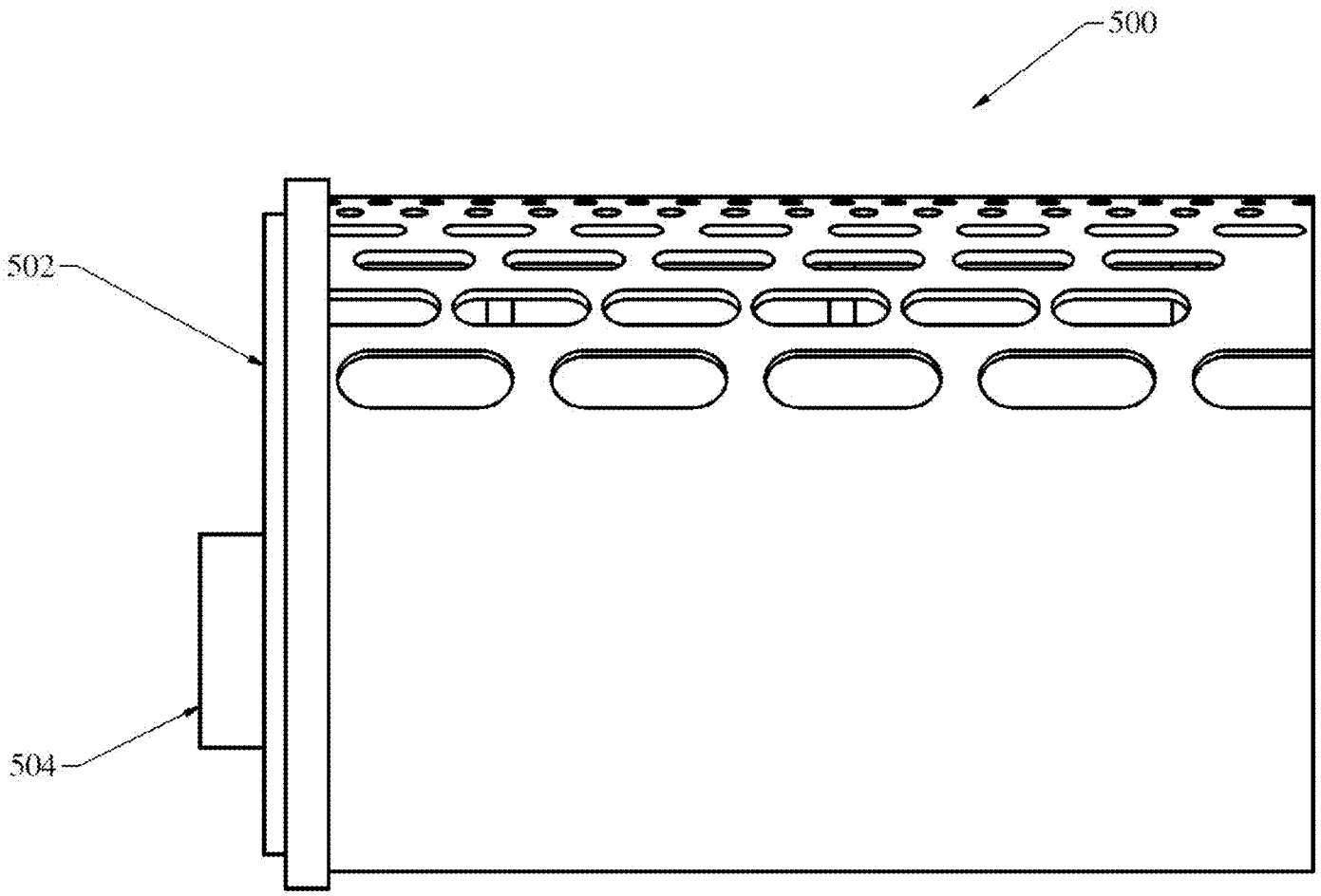
FIG. 5 illustrates another embodiment of a gutter system having an endcap with a removable port cap.

When the gutter system is installed, gutter run sections are attached to interior and exterior corner sections to fit the roof of the structure. The ends 500 of the gutter runs are plugged with endcaps 502, illustrated in FIG. 5, discussed below. The gutters connect to downspouts to carry the water to the ground. The various pieces of the gutter system are attached using joints or couplings. The joints must be made of a material that will allow the gutter to be unlatched for emptying, but will not leak when the gutter is in the closed or latched position. In the particular embodiment shown in FIG. 5, the endcap 502 includes a removable port cap 504. Another method of cleaning the gutter is to remove the removable port cap 504 to allow debris to be removed with a tool or flushed out of the trough and into the downspout with water from a water hose. In some embodiments, the endcap could include multiple port caps to flush multiple troughs.

Figure 6A:
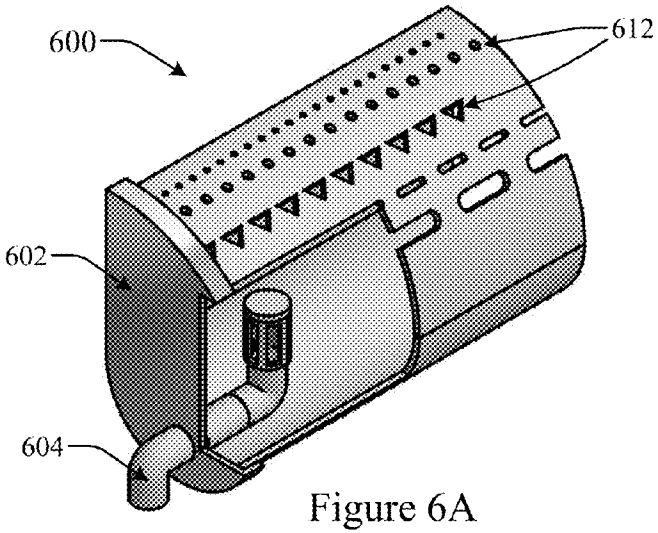
FIGS. 6A through 6C illustrate another embodiment of a gutter system having an endcap with a drainpipe.
Figure 6C:
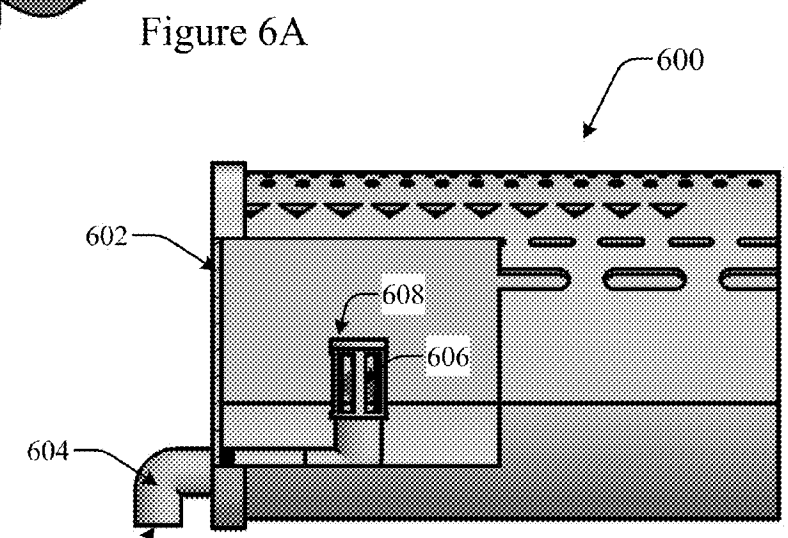
Figure 6B:
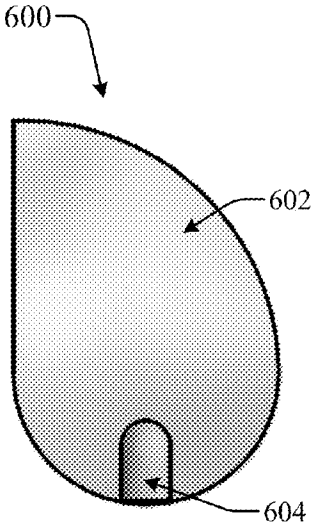

FIGS. 6A to 6C illustrate another example of the end of a gutter run 600 with a plurality of apertures 612. As shown, these apertures 612 may take on any number of shapes or sizes. An endcap 602 is placed over the end of the gutter run 600. The endcap 602 includes an opening that allows for a drainpipe 604 to be installed, which passes from the inside of the gutter 600 to the outside of the gutter 600. The portion of the drainpipe 604 that is on the inside of the gutter 600 bends upward. At the top end of the drainpipe 604, a ball 606 is located in a housing 608, which may include features such as a mesh, screen, or mechanisms to block debris from entering and clogging the drainpipe 604. The ball 606 may be designed such that it will float in water. The portion of the drainpipe 604 that is on the outside of the gutter 600 bends downward. At the bottom end of the drainpipe 604, there is an opening 610. The ball 606 acts as a valve, and will float upwardly as the gutter begins to fill with water. In this position, the valve is open, allowing water to drain out of the opening 610. The opening 610 can be attached to a garden hose or other suitable conduit to convey the water to a safe area for the water to be released. In other embodiments, the ball valve mechanism is not necessary.

Figure 7A:
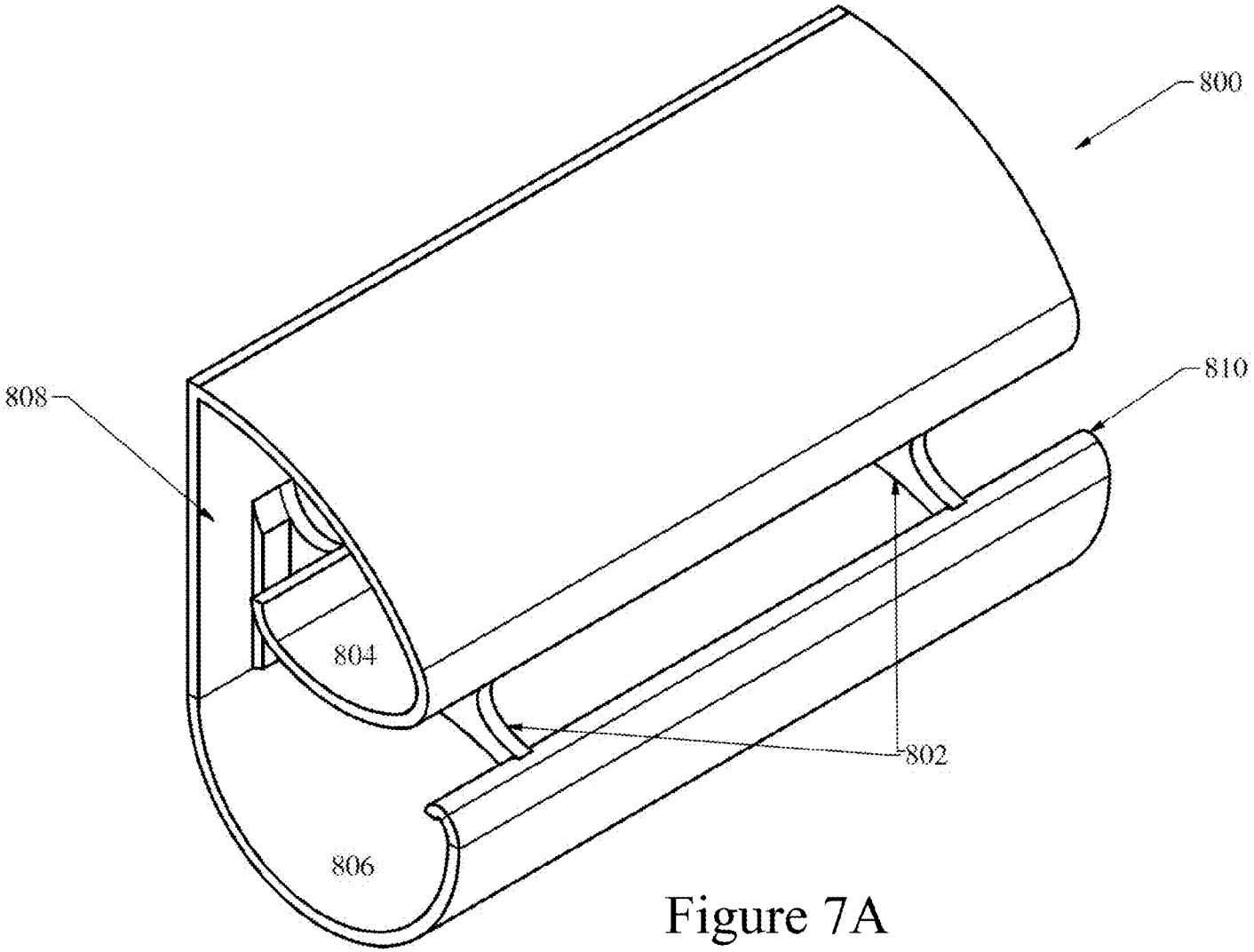
FIGS. 7A through 7C illustrate another embodiment of a gutter system including a frame for supporting an upper trough.
Figure 7B:
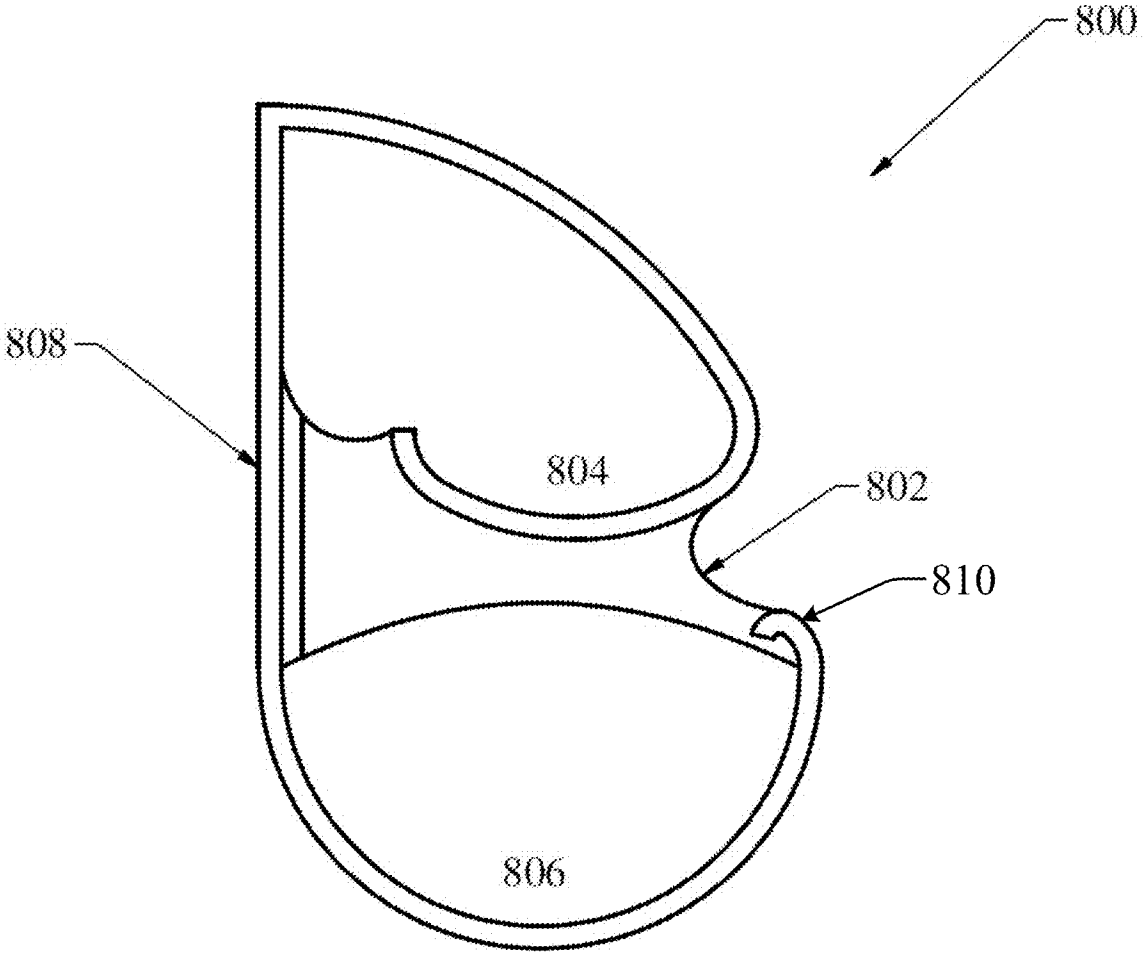
Figure 7C:
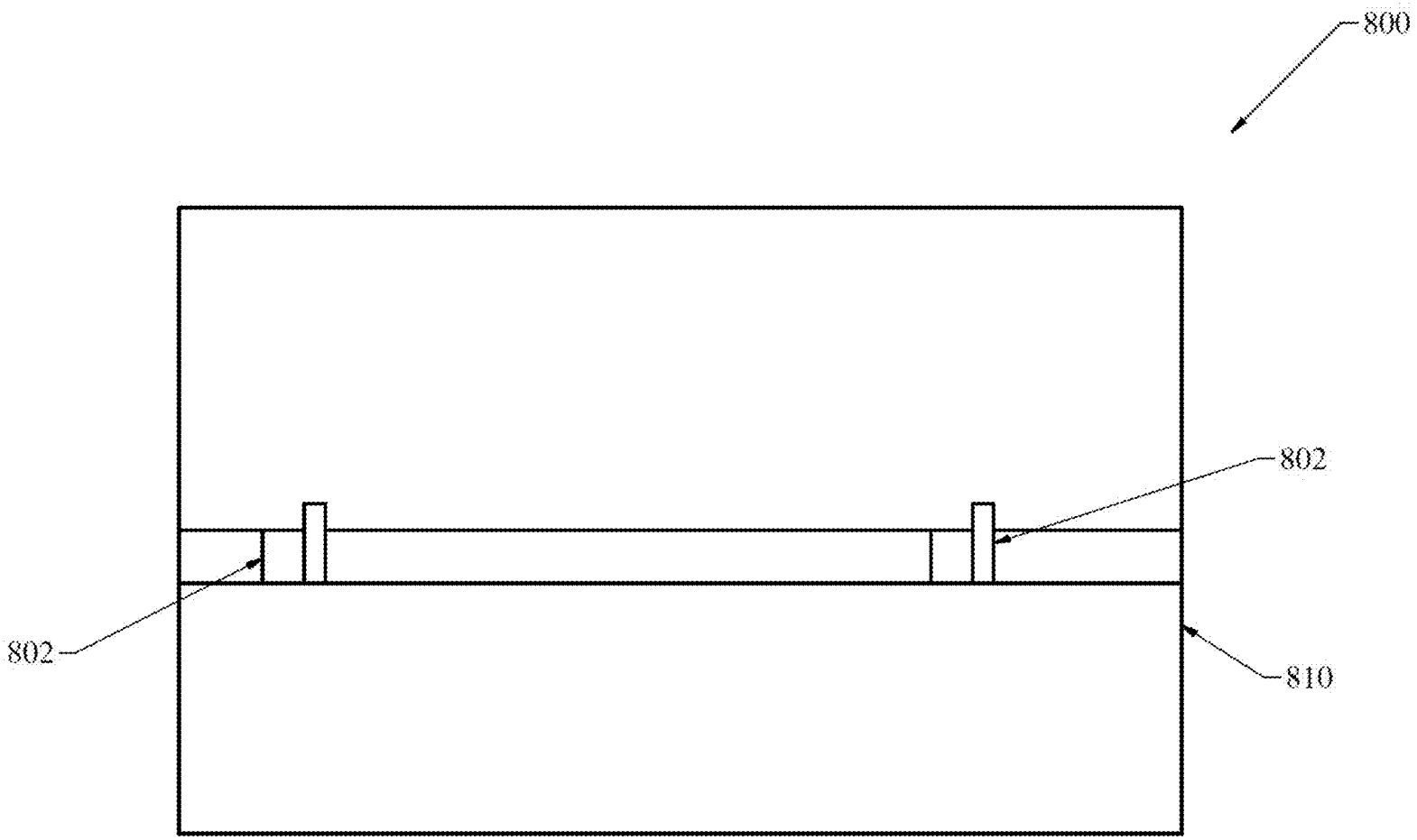

FIGS. 7A through 7C show an embodiment of a multi-trough gutter system 800 that is supported structurally by a frame 802. The upper trough 804 and the lower trough 806 are supported by the internal frame elements 802 at intervals along the length of the gutter run. The frame 802 attaches to the back wall 808 of the gutter 800. The frame 802 may also extend through the gutter 800 and also function as the fastening mechanism that attaches the gutter 800 to the structure. The frame 802 supports the upper trough 804 continually along the lower surface of the upper trough 804. The frame 802 also supports the lower trough 806 at or near the lip 810 of the lower trough 806. In this way, the frame 802 works to resist forces that might cause the lower trough 806 to sag under a heavy load. The particular version of the frame 802 shown in the figures merely illustrates one possible implementation for providing structural integrity to a gutter 800 incorporating an upper trough 804 and a lower trough 806. It is possible to envision other types of frames 802 being used. It is also possible to envision using a frame 802 in other embodiments of the invention.

FIGS. 8A through 8C illustrate one embodiment of a gutter system 900 incorporating a flange under shingle feature 902, which may be incorporated with any of the above embodiments to prevent water from flowing behind the gutter. The shingles may be installed on the structure such that the lowest edge of the shingles is not a constant distance from the wall of the structure along the length of the building. In this case, installing the Flange Under Shingles system helps to ensure that the flowing water and debris will enter the gutter system 900. Flange 902 extends from the back wall 906 of the gutter 900 and fits under the shingles which are adjacent to the gutter 900. In the particular embodiment of FIGS. 8A through 8C, slot 904 is located where the flange 902 meets the back wall 906 of the gutter 900. Slot 904 allows water to enter the lower trough 908.

Holes 910 in the visor 903 allow water that flows over the slot 904 to enter the upper trough 912. A frame (e.g. a bracket, support, or other structure) may be used to maintain the spacing of slot 904 when water is flowing into and over the gutter 900. In this embodiment, there is no coanda slot. The upper trough 912 extends from the top edge of the visor 903, as opposed to the embodiment with a coanda slot, wherein the upper trough extends from the bottom edge of the visor.

Figure 9A:
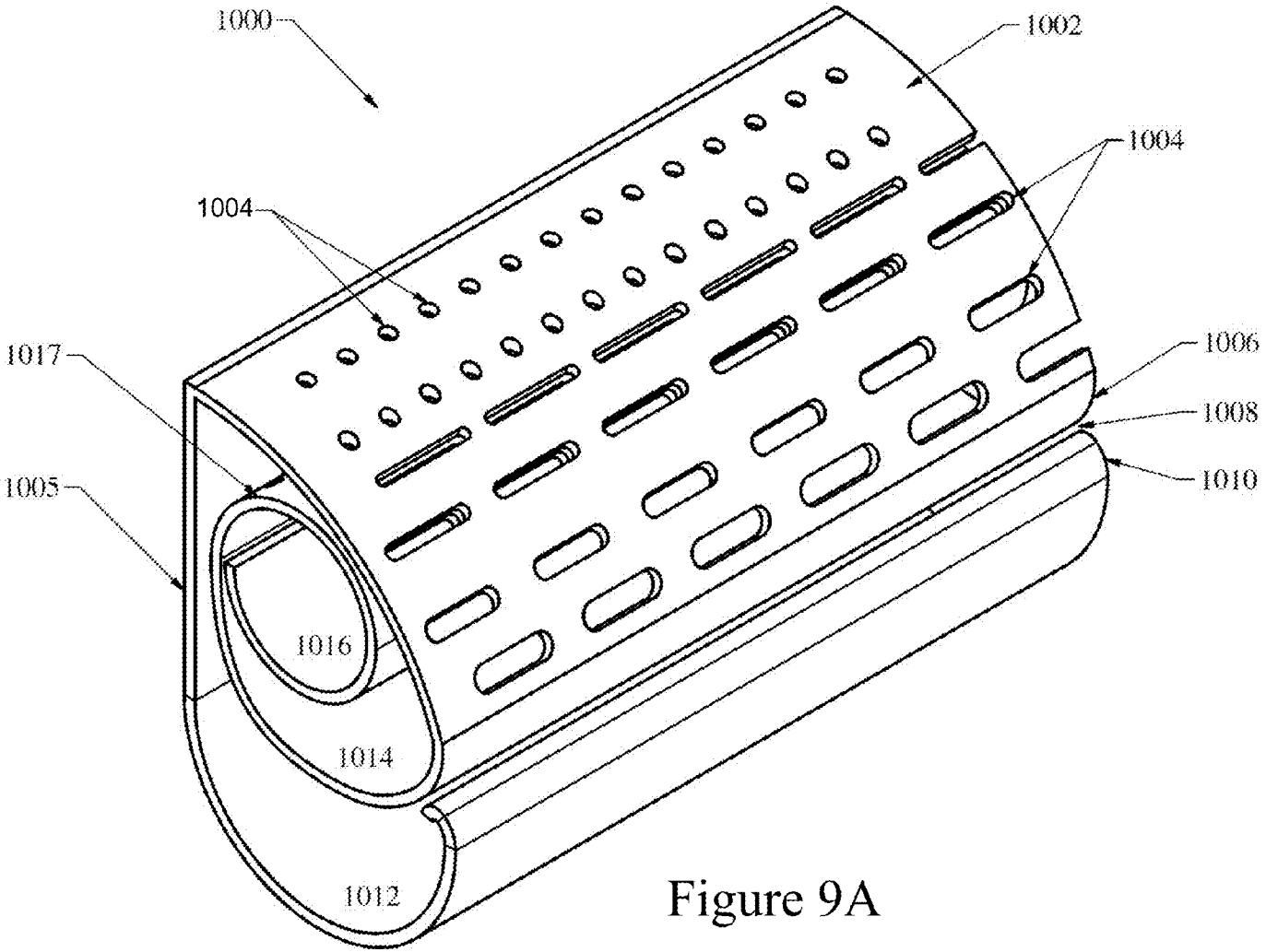
FIGS. 9A through 9C illustrate another embodiment of a gutter system including multiple troughs.
Figure 9B:
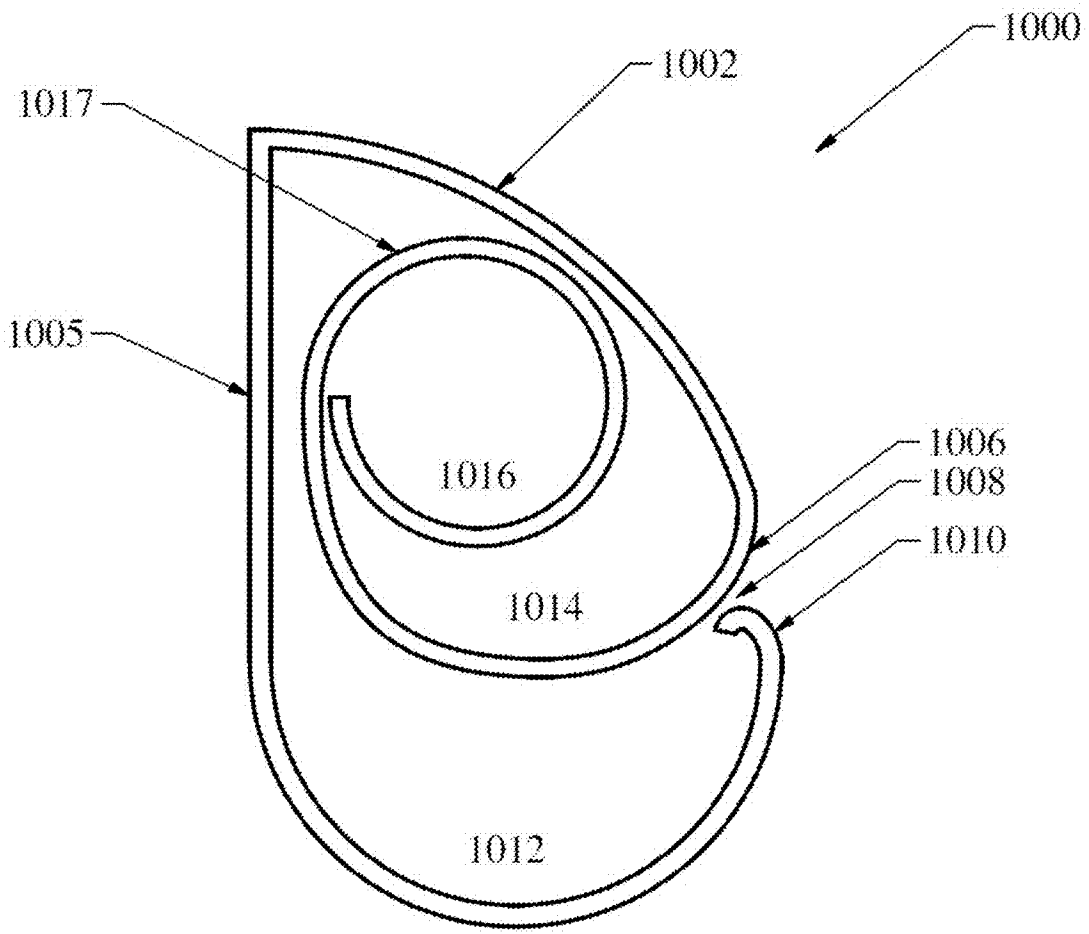
Figure 9C:
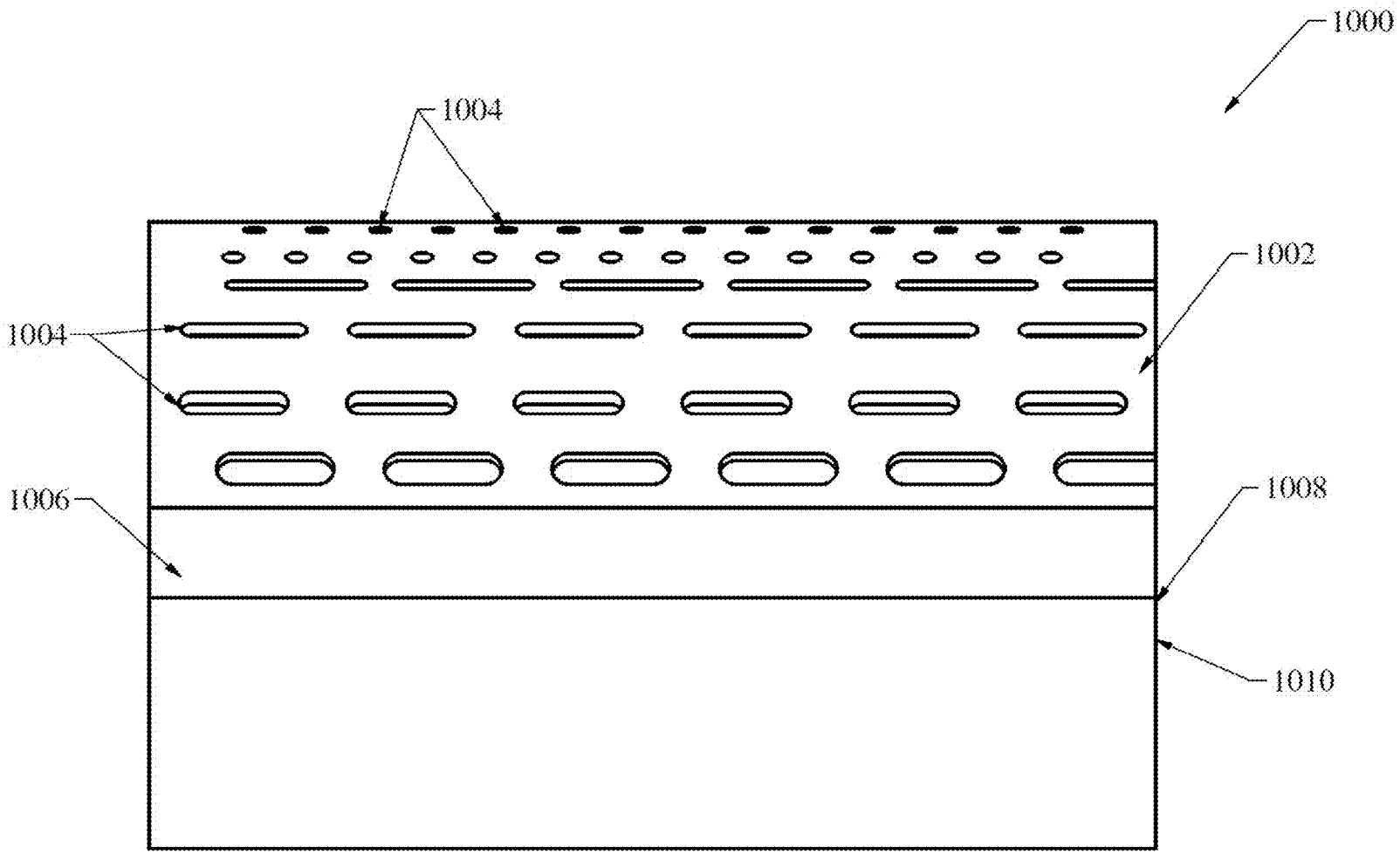

FIGS. 9A through 9C illustrate an embodiment of a gutter 1000 comprising a visor 1002 with a plurality of holes 1004 to entrain water as it moves down the surface of the visor 1002. The visor 1002 may slope down towards an upper curvature 1006 that defines the upper boundary of a coanda slot 1008. A lower curvature 1010 may define the lower boundary of the coanda slot 1008. The visor 1002, holes 1004, coanda slot 1008 and upper and lower curvatures 1006, 1010 may function similarly to the other embodiments of the gutter described above.

Still referring to FIGS. 9A through 9C, the lower curvature 1010 may extend from the back wall 1005 to form the first trough 1012 at the bottom of the gutter 1000. Similarly, the upper curvature 1006 may extend inside the gutter 1000 to form the second trough 1014, and then extend further to form an internal visor 1017 and third trough 1016. The gutter 1000 with multiple internal troughs 1012, 1014, 1016 provides additional water carrying capacity and redundancy compared to gutters with fewer troughs. While three troughs 1012, 1014, 1016 are shown, the gutter 1000 may include as many troughs as necessary to provide adequate water capacity for a particular application. As shown, the gutter 1000 may have a first trough 1012 at the bottom of the gutter 1000 fed principally by the coanda slot 1008. The second trough 1014 and third trough 1016 may receive water entrained in the holes 1004 in the visor 1002. The internal visor 1017 may have holes similar to the visor 1002 designed to allow water to enter the third trough 1016 but to reject or otherwise discard debris from entering the third trough. The use of multiple troughs 1012, 1014, 1016 allows for increased water carrying capacity because additional troughs 1012, 1014, 1016 allow for better utilization of the full internal volume of the gutter 1000 without overflow or spillage. Furthermore, multiple troughs 1012, 1014, 1016 may also provide redundancy such that if any individual trough becomes clogged or otherwise obstructed, additional troughs are may still be clear and deliver water to a downspout or other water flow path. As shown in FIGS. 9A through 9C, the gutter 1000 with multiple troughs 1012, 1014, 1016 may be made by bending or otherwise forming a single sheet of material. In some embodiments, the gutter 1000 may be made of separate pieces bonded, fastened, or otherwise joined together.

Figure 10A:
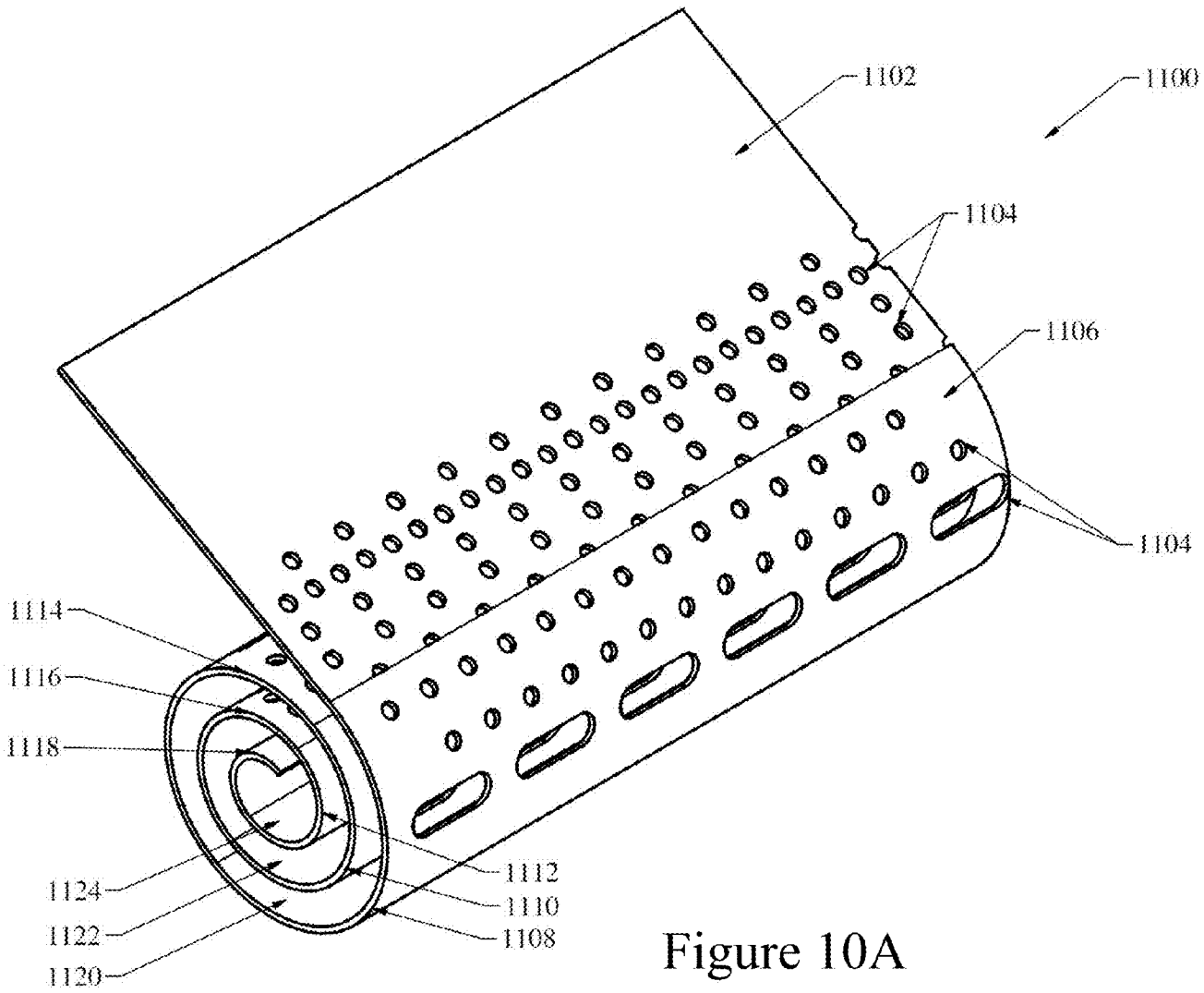
FIGS. 10A through 10C illustrate another embodiment of a gutter system including a spiral trough.
Figure 10B:
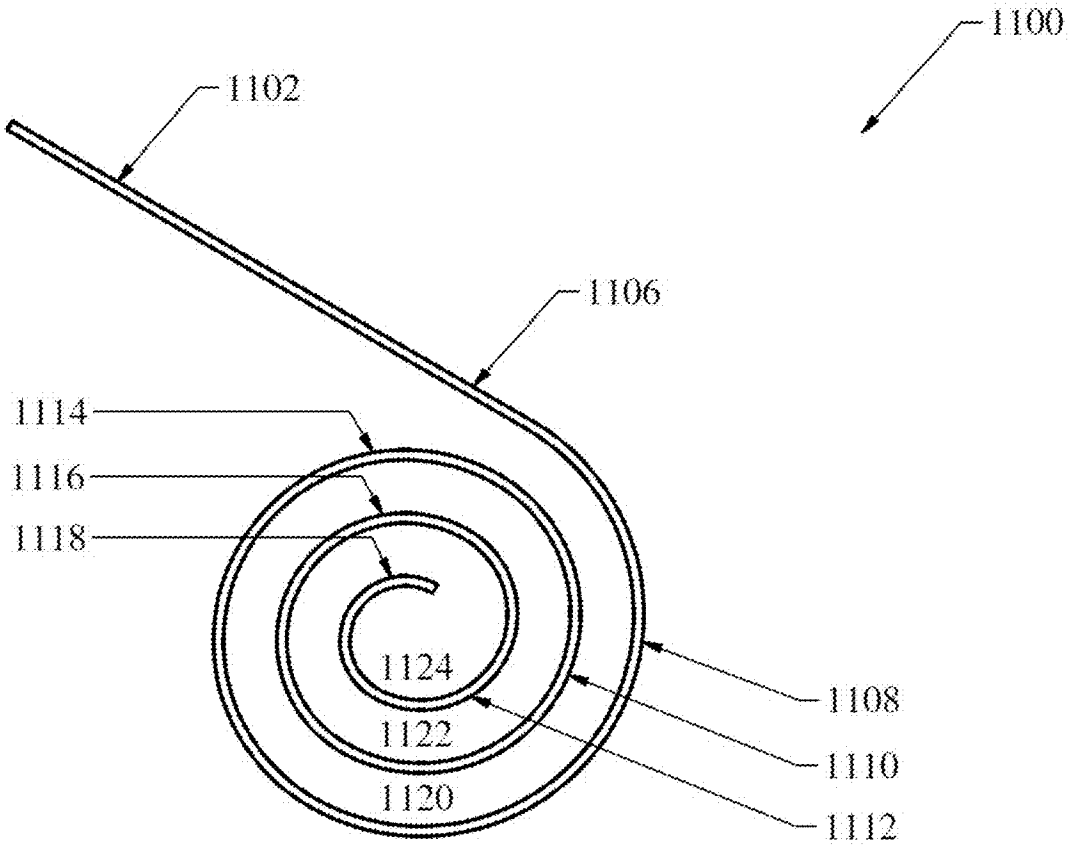
Figure 10C:
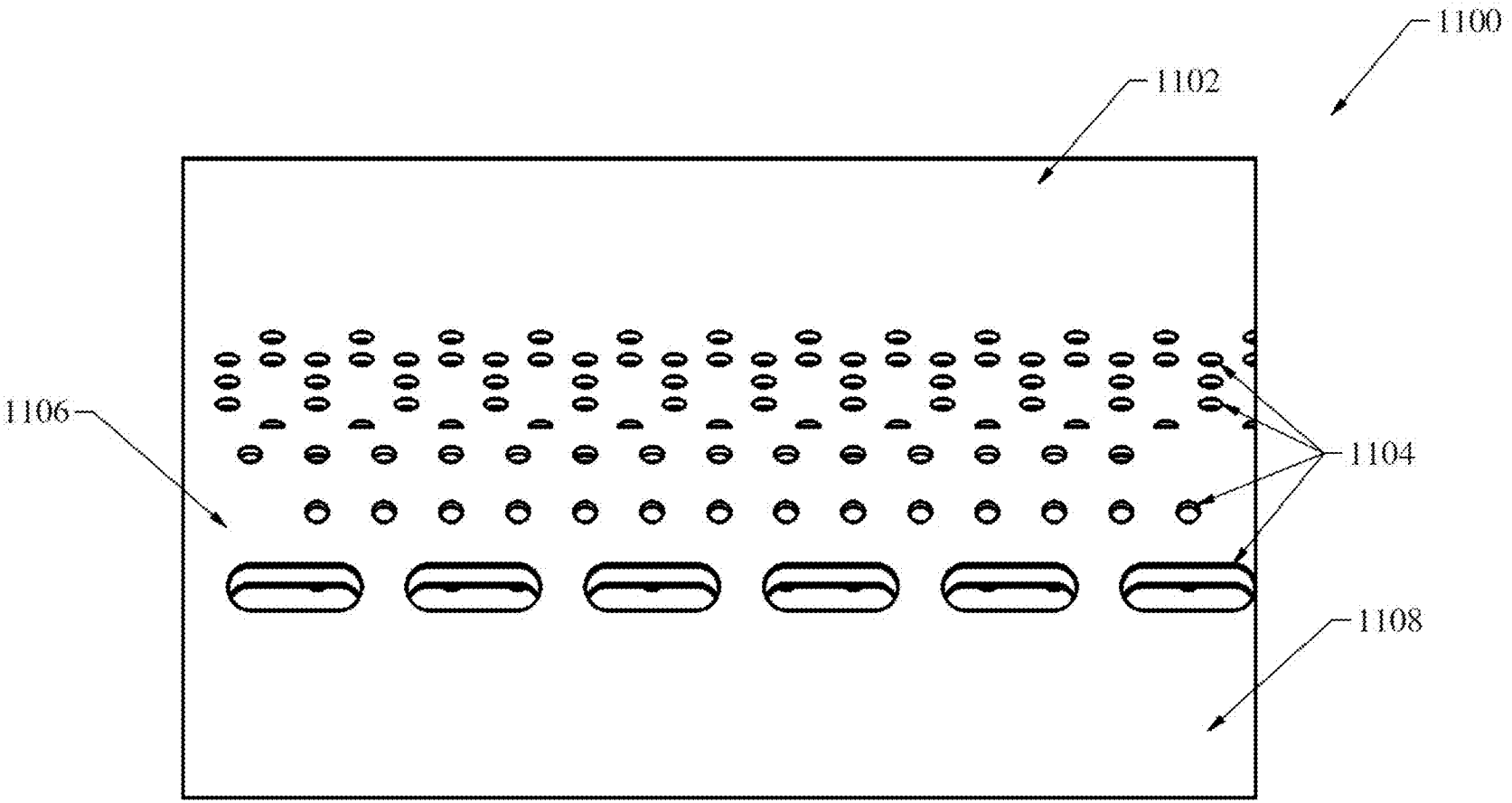

FIGS. 10A through 10C provide an illustration of an infinite spiral gutter 1100. The infinite spiral gutter 1100 may comprise a flange 1102 extending down to an outer visor 1106 which may have a plurality of holes 1004. The flange 1102, outer visor 1106, and/or holes 1104 may function similarly to other embodiments of the gutter system described above. As shown, the infinite spiral gutter 1100 may be attached to a roof or other supporting structure through the flange 1102. However, in certain embodiments, the infinite spiral gutter 1100 may not include a flange 1102 and may instead be secured to a structure using a frame or mounting fasteners.

Still referring to FIGS. 10A through 10C, the infinite spiral gutter 1100 may be formed from a single sheet of material. For example, a single sheet of metal or other suitable material may initially be flat to form the flange 1102. The flange 1102 may then transition into the outer visor 1106 with a plurality of holes 1104. The outer visor 1106 may then transition into the outer coil 1108 and begin to arc down to form the lower trough 1120. The material may then continue to arc around from the lower trough 1120 in a spiral to form an inner visor 1114, inner coil 1110, inner trough 1122, second inner visor 1116, center coil 1112, center trough 1124, and center visor 1118. As shown, the infinite spiral gutter 1100 is depicted as having three troughs 1120, 1122, 1124, each having a corresponding visor 1114, 1116, 1118 that may include holes similar to the holes 1104 in the outer visor 1106. However, in some embodiments, the infinite spiral gutter 1100 may have as many troughs between the lower trough 1120 and center trough 1124 formed from any number of coils 1108, 1110, 1112 as desired or required for a particular application.

The infinite spiral gutter 1100 may offer a number of advantages over traditional gutters. Similar to the gutter 1000 described in FIGS. 9A through 9C above, the infinite spiral gutter 1100 may have increased water carrying capacity and redundancy because of the multiple troughs 1120, 1122, 1124 with multiple visors 1106, 1114, 1116, 1118 to filter out debris. Each successive trough 1120, 1122, 1124 may increase the water carrying capacity of the infinite spiral gutter 1100 and provide redundant drainage paths should one or more of the troughs 1120, 1122, 1124 become clogged or otherwise obstructed by debris. The infinite spiral gutter 1100 may also provide significant advantages in manufacturing and flexibility. Because the infinite spiral gutter 1100 may, in certain embodiments, be formed from a single sheet of material, many different configurations of the infinite spiral gutter 1100 may be made using the same material stock and processing equipment. For example, the outer diameter, number of coils, and/or spacing between individual coils may be changed or adapted to any particular application. Furthermore, while the infinite spiral gutter 1100 is shown with generally circular coils, alternative embodiments may have oval, square, rectangular, or any other desired shape of coils to adapt the infinite spiral gutter 1100 for fit, compatibility with different structures, and/or aesthetic purposes.

The foregoing is provided for purposes of illustrating, describing, and explaining aspects of the present invention and is not intended to be exhaustive or to limit the invention to the precise forms disclosed. Further modifications and adaptation of these embodiments will be apparent to those skilled in the art and may be made without departing from the scope and spirit of the invention. Different arrangements of the components depicted in the drawings or described above, as well as components not shown or described are possible. Similarly, some features are useful and may be employed without reference to other features. Embodiments of the invention have been described for illustrative and not restrictive purposes, and alternative embodiments will become apparent to readers of this patent. For example, the physical design of the interlocking roof gutter may differ from that described herein.

Any of the above described components, parts, or embodiments may take on a range of shapes, sizes, or materials as necessary for a particular application of the described invention. The components, parts, or mechanisms of the described invention may be made of any materials selected for the suitability in use, cost, or ease of manufacturing. Materials including, but not limited to aluminum, stainless steel, fiber reinforced plastics, carbon fiber, composites, polycarbonate, polypropylene, other metallic materials, or other polymers may be used to form any of the above described components.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A roof gutter, comprising: a first end and a second end; an elongated trough extending between the first end and the second end, the elongated trough including an inner side and an outer side, a bottom of the elongated trough sloping downward from the first end to the second end; a curved visor positioned over the elongated trough and curving downwardly from a top portion towards the outer side of the elongated trough;

a distance between the top portion of the curved visor and the bottom of the elongated trough increasing as the elongated trough extends from the first end to the second end; and a coanda slot extending between the outer side of the elongated trough and the curved visor;

wherein the bottom of the elongated trough defines a rounded trough;

a second elongated trough positioned above the elongated trough;

the second elongated trough is defined by a portion of the curved visor curving inwardly from the coanda slot;

one or more subsequent elongated troughs positioned above the second elongated trough;

wherein the one or more subsequent elongated troughs are defined by a portion of the second elongated trough curving in an inward spiral to form one or more subsequent visors, each of the one or more subsequent visors comprising a plurality of holes.

2. The roof gutter of claim 1, wherein the elongated trough and the curved visor both extend from a planar back member.

3. The roof gutter of claim 1, wherein the curved visor further comprises a plurality of openings extending through the curved visor.

4. The roof gutter of claim 3, wherein the plurality of openings comprise a plurality of different sized openings.

5. The roof gutter of claim 4, wherein a size of the plurality of openings increases as the visor curves downwardly towards the elongated trough.

6. The roof gutter of claim 1, wherein the elongated trough and the curved visor both extend from a planar back member, and wherein a frame support extends between the planar back member and a lower portion of the curved visor.

* * * * *